US009605680B2

(12) United States Patent
Stiles, Jr. et al.

(10) Patent No.: US 9,605,680 B2
(45) Date of Patent: Mar. 28, 2017

(54) CONTROL ALGORITHM OF VARIABLE SPEED PUMPING SYSTEM

(71) Applicants: Pentair Water Pool and Spa, Inc., Cary, NC (US); Danfoss Drives A/S, Graasten (DK)

(72) Inventors: Robert W. Stiles, Jr., Cary, NC (US); Lars Hoffmann Berthelsen, Kolding (DK); Ronald B. Robol, Savannah, GA (US); Everett Cox, Sanford, NC (US); Donald Steen, Sanford, NC (US); Kevin Murphy, Quartz Hill, CA (US); Daniel J. Hruby, Sanford, NC (US); Peter Westermann-Rasmussen, Soenderborg (DK); Gert Kjaer, Soenderborg (DK); Nils-Ole Harvest, Nordborg (DK); Christopher Yahnker, Valencia, CA (US); Walter Woodcock, Jr., Sanford, NC (US); Einar Kjartan Runarsson, Soenderborg (DK); Arne Fink Hansen, Graasten (DK); Alberto Morando, Soenderborg (DK); Florin Lungeanu, Graasten (DK)

(73) Assignees: Pentair Water Pool and Spa, Inc., Cary, NC (US); Danfoss Drives A/S, Graasten (DK)

( * ) Notice: Subject to any disclaimer, the term of this patent is extended or adjusted under 35 U.S.C. 154(b) by 0 days.

(21) Appl. No.: 14/325,887

(22) Filed: Jul. 8, 2014

(65) Prior Publication Data

US 2014/0322030 A1 Oct. 30, 2014

Related U.S. Application Data

(63) Continuation of application No. 13/230,678, filed on Sep. 12, 2011, now Pat. No. 9,404,500, and a (Continued)

(51) Int. Cl.
*G05D 7/00* (2006.01)
*F04F 5/00* (2006.01)

(Continued)

(52) U.S. Cl.
CPC ..... *F04D 15/0066* (2013.01)

(58) Field of Classification Search
CPC ..... F04D 15/0066

(Continued)

(56) References Cited

U.S. PATENT DOCUMENTS 981,213 A 1/1911 Mollitor
1,993,267 A 3/1935 Ferguson (Continued)

FOREIGN PATENT DOCUMENTS

AU 3940997 2/1998
AU 2005204246 A1 3/2006

(Continued)

OTHER PUBLICATIONS

Flotec Owner's Manual, dated 2004. 44 pages.

(Continued)

*Primary Examiner* — Robert Fennema
*Assistant Examiner* — Thomas Stevens
(74) *Attorney, Agent, or Firm* — Quarles & Brady LLP

(57) ABSTRACT

A pumping system includes a pump for moving water. In one aspect, this is in connection with performance of an operation. The system includes a variable speed motor operatively connected to drive the pump. A value indicative of flow rate of water is determined and the motor is controlled to adjust the flow rate indicative value toward a constant. A value indicative of flow pressure is determined and the motor is controlled to adjust the flow pressure indicative value toward a constant. A selection is made between flow rate control and flow pressure control. In another aspect, the (Continued)

pump is controlled to perform a first operation, and is operated to perform a second water operation. Control of operation of the pump to perform the first water operation is altered in response to operation of the pump to perform the second operation.

11 Claims, 10 Drawing Sheets

Related U.S. Application Data continuation of application No. 11/286,888, filed on Nov. 23, 2005, now Pat. No. 8,019,479, and a continuation-in-part of application No. 10/926,513, filed on Aug. 26, 2004, now Pat. No. 7,874,808.

(51) Int. Cl.
*F04B 23/08* (2006.01)
*F04D 15/00* (2006.01)

(58) Field of Classification Search
USPC ..... 417/175, 199.2; 700/282
See application file for complete search history.

(56) References Cited

U.S. PATENT DOCUMENTS 2,238,597 A 4/1941 Page
2,458,006 A 1/1949 Kilgore
2,488,365 A 11/1949 Abbott et al.
2,494,200 A 1/1950 Ramqvist
2,615,937 A 10/1952 Ludwig
2,716,195 A 8/1955 Anderson
2,767,277 A 10/1956 Wirth
2,778,958 A 1/1957 Hamm et al.
2,881,337 A 4/1959 Wall
3,116,445 A 12/1963 Wright
3,191,935 A 6/1965 Uecker
3,204,423 A 9/1965 Resh, Jr.
3,213,304 A 10/1965 Landerg et al.
3,226,620 A 12/1965 Elliott et al.
3,227,808 A 1/1966 Morris
3,291,058 A 12/1966 McFarlin
3,316,843 A 5/1967 Vaughan
3,481,973 A 12/1969 Wygant
3,530,348 A 9/1970 Connor
3,558,910 A 1/1971 Dale et al.
3,559,731 A 2/1971 Stafford
3,562,614 A 2/1971 Gramkow
3,566,225 A 2/1971 Paulson
3,573,579 A 4/1971 Lewus
3,581,895 A 6/1971 Howard et al.
3,593,081 A 7/1971 Forst
3,594,623 A 7/1971 LaMaster
3,596,158 A 7/1971 Watrous
3,613,805 A 10/1971 Lindstad
3,624,470 A 11/1971 Johnson
3,634,842 A 1/1972 Niedermeyer
3,652,912 A 3/1972 Bordonaro
3,671,830 A 6/1972 Kruger
3,712,511 A * 1/1973 Magnasco ..... 222/52
3,726,606 A 4/1973 Peters
1,061,919 A 5/1973 Miller
3,735,233 A 5/1973 Ringle
3,737,749 A 6/1973 Schmit
3,753,072 A 8/1973 Jurgens
3,761,750 A 9/1973 Green
3,761,792 A 9/1973 Whitney
3,777,232 A 12/1973 Woods et al.
3,778,804 A 12/1973 Adair
3,780,759 A 12/1973 Yahle et al.
3,781,925 A 1/1974 Curtis
3,787,882 A 1/1974 Fillmore
3,792,324 A 2/1974 Suarez
3,800,205 A 3/1974 Zalar
3,814,544 A 6/1974 Roberts et al.
3,838,597 A 10/1974 Montgomery et al.
3,867,071 A 2/1975 Hartley
3,882,364 A 5/1975 Wright
3,902,369 A 9/1975 Metz
3,910,725 A 10/1975 Rule
3,913,342 A 10/1975 Barry
3,916,274 A 10/1975 Lewus
3,936,231 A * 2/1976 Douglas ..... 417/12
3,941,507 A 3/1976 Niedermeyer
3,947,530 A * 3/1976 Marder ..... 261/7
3,949,782 A 4/1976 Athey et al.
3,953,777 A 4/1976 McKee
3,956,760 A 5/1976 Edwards
3,963,375 A 6/1976 Curtis
3,972,647 A 8/1976 Niedermeyer
3,976,919 A 8/1976 Vandevier
3,987,240 A 10/1976 Schultz
4,000,446 A 12/1976 Vandevier
4,021,700 A 5/1977 Ellis-Anwyl
4,037,598 A * 7/1977 Georgi ..... 604/65
4,041,470 A 8/1977 Slane et al.
4,061,442 A 12/1977 Clark et al.
4,087,204 A 5/1978 Niedermeyer
4,108,574 A 8/1978 Bartley et al.
4,123,792 A 10/1978 Gephart et al.
4,133,058 A 1/1979 Baker
4,142,415 A 3/1979 Jung et al.
4,151,080 A 4/1979 Zuckerman et al.
4,168,413 A 9/1979 Halpine
4,169,377 A 10/1979 Scheib
4,182,363 A 1/1980 Fuller et al.
4,185,187 A 1/1980 Rogers
4,187,503 A 2/1980 Walton
4,206,634 A 6/1980 Taylor
4,215,975 A 8/1980 Niedermeyer
4,222,711 A 9/1980 Mayer
4,225,290 A 9/1980 Allington
4,228,427 A 10/1980 Niedermeyer
4,233,553 A 11/1980 Prince
4,241,299 A 12/1980 Bertone
4,255,747 A 3/1981 Bunia
4,263,535 A 4/1981 Jones
4,276,454 A 6/1981 Zathan
4,286,303 A 8/1981 Genheimer et al.
4,303,203 A 12/1981 Avery
4,307,327 A 12/1981 Streater et al.
4,309,157 A 1/1982 Niedermeyer
4,314,478 A 2/1982 Beaman
4,319,712 A 3/1982 Bar
4,322,297 A 3/1982 Bajka
4,330,412 A 5/1982 Frederick
4,334,535 A * 6/1982 Wilson et al. ..... 604/82
4,353,220 A 10/1982 Curwein
4,366,426 A 12/1982 Turlej
4,369,438 A 1/1983 Wilhelmi
4,370,098 A 1/1983 McClain et al.
4,370,690 A 1/1983 Baker
4,371,315 A 2/1983 Shikasho
4,375,613 A 3/1983 Fuller et al.
4,384,825 A 5/1983 Thomas et al.
4,399,394 A 8/1983 Ballman
4,402,094 A 9/1983 Sanders
4,409,532 A 10/1983 Hollenbeck
4,419,625 A 12/1983 Bejot et al.
4,420,787 A 12/1983 Tibbits et al.
4,421,643 A 12/1983 Frederick
4,425,836 A 1/1984 Pickrell
4,427,545 A 1/1984 Arguilez
4,428,434 A 1/1984 Gelaude
4,429,343 A 1/1984 Freud
4,437,133 A 3/1984 Rueckert
4,448,072 A 5/1984 Tward
4,449,260 A 5/1984 Whitaker
4,453,118 A 6/1984 Phillips
4,456,432 A 6/1984 Mannino
4,462,758 A 7/1984 Speed
4,463,304 A 7/1984 Miller

(56) References Cited

U.S. PATENT DOCUMENTS 4,468,604 A 8/1984 Zaderej
4,470,092 A 9/1984 Lombardi
4,473,338 A 9/1984 Garmong
4,494,180 A 1/1985 Streater
4,496,895 A 1/1985 Kawate et al.
4,504,773 A 3/1985 Suzuki et al.
4,505,643 A 3/1985 Millis et al.
D278,529 S 4/1985 Hoogner
4,514,989 A 5/1985 Mount
4,520,303 A 5/1985 Ward
4,529,359 A 7/1985 Sloan
4,541,029 A 9/1985 Ohyama
4,545,906 A 10/1985 Frederick
4,552,512 A 11/1985 Gallup et al.
4,564,041 A 1/1986 Kramer
4,564,882 A 1/1986 Baxter
4,581,900 A 4/1986 Lowe
4,604,563 A 8/1986 Min
4,605,888 A 8/1986 Kim
4,610,605 A 9/1986 Hartley
4,620,835 A 11/1986 Bell
4,622,506 A 11/1986 Shemanske
4,635,441 A 1/1987 Ebbing et al.
4,647,825 A 3/1987 Profio et al.
4,651,077 A 3/1987 Woyski
4,652,802 A 3/1987 Johnston
4,658,195 A 4/1987 Min
4,658,203 A 4/1987 Freymuth
4,668,902 A 5/1987 Zeller, Jr.
4,670,697 A 6/1987 Wrege
4,676,914 A 6/1987 Mills et al.
4,678,404 A 7/1987 Lorett et al.
4,678,409 A 7/1987 Kurokawa
4,686,439 A 8/1987 Cunningham
4,695,779 A 9/1987 Yates
4,697,464 A 10/1987 Martin
4,703,387 A 10/1987 Miller
4,705,629 A 11/1987 Weir
4,716,605 A 1/1988 Shepherd
4,719,399 A 1/1988 Wrege
4,728,882 A 3/1988 Stanbro
4,751,449 A 6/1988 Chmiel
4,751,450 A 6/1988 Lorenz
4,758,697 A 7/1988 Jeuneu
4,761,601 A 8/1988 Zaderej
4,764,417 A 8/1988 Gulya
4,764,714 A 8/1988 Alley
4,766,329 A 8/1988 Santiago
4,767,280 A 8/1988 Markuson
4,780,050 A 10/1988 Caine et al.
4,781,525 A 11/1988 Hubbard
4,782,278 A 11/1988 Bossi
4,786,850 A 11/1988 Chmiel
4,789,307 A 12/1988 Sloan
4,795,314 A 1/1989 Prybella et al.
4,801,858 A 1/1989 Min
4,804,901 A 2/1989 Pertessis
4,806,457 A 2/1989 Yanagisawa
4,820,964 A 4/1989 Kadah
4,827,197 A 5/1989 Giebler
4,834,624 A 5/1989 Jensen
4,837,656 A 6/1989 Barnes
4,839,571 A 6/1989 Farnham
4,841,404 A 6/1989 Marshall et al.
4,843,295 A 6/1989 Thompson
4,862,053 A 8/1989 Jordan
4,864,287 A 9/1989 Kierstead
4,885,655 A 12/1989 Springer et al.
4,891,569 A 1/1990 Light
4,896,101 A 1/1990 Cobb
4,907,610 A 3/1990 Meincke
4,912,936 A 4/1990 Denpou
4,913,625 A 4/1990 Gerlowski
4,949,748 A 8/1990 Chatrathi
4,958,118 A 9/1990 Pottebaum
4,963,778 A 10/1990 Jensen
4,967,131 A 10/1990 Kim
4,971,522 A 11/1990 Butlin
4,975,798 A 12/1990 Edwards et al.
4,977,394 A 12/1990 Manson et al.
4,985,181 A 1/1991 Strada et al.
4,986,919 A 1/1991 Allington
4,996,646 A 2/1991 Farrington
D315,315 S 3/1991 Stairs, Jr.
4,998,097 A 3/1991 Noth et al.
5,015,151 A 5/1991 Snyder, Jr. et al.
5,015,152 A 5/1991 Greene
5,017,853 A 5/1991 Chmiel
5,026,256 A 6/1991 Kuwabara
5,041,771 A 8/1991 Min
5,051,068 A 9/1991 Wong
5,051,681 A 9/1991 Schwarz
5,076,761 A 12/1991 Krohn
5,076,763 A 12/1991 Anastos et al.
5,079,784 A 1/1992 Rist et al.
5,091,817 A 2/1992 Alley
5,098,023 A 3/1992 Burke
5,099,181 A 3/1992 Canon
5,100,298 A 3/1992 Shibata
RE33,874 E 4/1992 Miller
5,103,154 A 4/1992 Dropps
5,117,233 A 5/1992 Hamos et al.
5,123,080 A 6/1992 Gillett
5,129,264 A 7/1992 Lorenc
5,135,359 A 8/1992 Dufresne
5,145,323 A 9/1992 Farr
5,151,017 A * 9/1992 Sears et al. ..... 417/45
5,154,821 A * 10/1992 Reid ..... 210/167.1
5,156,535 A 10/1992 Budris
5,158,436 A 10/1992 Jensen
5,159,713 A 10/1992 Gaskell
5,164,651 A 11/1992 Hu
5,166,595 A 11/1992 Leverich
5,167,041 A 12/1992 Burkitt
5,172,089 A 12/1992 Wright et al.
D334,542 S 4/1993 Lowe
5,206,573 A 4/1993 McCleer et al.
5,222,867 A 6/1993 Walker, Sr. et al.
5,234,286 A 8/1993 Wagner
5,234,319 A 8/1993 Wilder
5,235,235 A 8/1993 Martin
5,238,369 A 8/1993 Farr
5,240,380 A 8/1993 Mabe
5,245,272 A 9/1993 Herbert
5,247,236 A 9/1993 Schroeder
5,255,148 A 10/1993 Yeh
5,272,933 A 12/1993 Collier
5,295,790 A 3/1994 Bossart et al.
5,295,857 A 3/1994 Toly
5,296,795 A 3/1994 Dropps
5,302,885 A 4/1994 Schwarz
5,319,298 A 6/1994 Wanzong et al.
5,324,170 A 6/1994 Anastos et al.
5,327,036 A 7/1994 Carey
5,342,176 A 8/1994 Redlich
5,347,664 A 9/1994 Hamza et al.
5,349,281 A 9/1994 Bugaj
5,351,709 A 10/1994 Vos
5,351,714 A 10/1994 Barnowski
5,352,969 A 10/1994 Gilmore et al.
5,361,215 A 11/1994 Tompkins
5,363,912 A 11/1994 Wolcott
5,394,748 A 3/1995 McCarthy
5,418,984 A 5/1995 Livingston, Jr.
D359,458 S 6/1995 Pierret
5,422,014 A 6/1995 Allen et al.
5,423,214 A 6/1995 Lee
5,425,624 A 6/1995 Williams
5,443,368 A 8/1995 Weeks et al.
5,444,354 A 8/1995 Takahashi
5,449,274 A 9/1995 Kochan, Jr.
5,449,997 A 9/1995 Gilmore et al.
5,450,316 A 9/1995 Gaudet et al.
D363,060 S 10/1995 Hunger

(56) References Cited

U.S. PATENT DOCUMENTS 5,457,373 A 10/1995 Heppe et al.
5,464,327 A * 11/1995 Horwitz ..... 417/12
5,471,125 A 11/1995 Wu
5,473,497 A 12/1995 Beatty
5,483,229 A 1/1996 Tamura et al.
5,495,161 A 2/1996 Hunter
5,499,902 A 3/1996 Rockwood
5,511,397 A 4/1996 Makino et al.
5,512,809 A 4/1996 Banks et al.
5,512,883 A 4/1996 Lane
5,518,371 A 5/1996 Wellstein
5,519,848 A 5/1996 Wloka
5,520,517 A 5/1996 Sipin
5,522,707 A 6/1996 Potter
5,528,120 A 6/1996 Brodetsky
5,529,462 A 6/1996 Hawes
5,532,635 A 7/1996 Watrous
5,540,555 A 7/1996 Corso et al.
D372,719 S 8/1996 Jensen
5,545,012 A 8/1996 Anastos et al.
5,548,854 A 8/1996 Bloemer et al.
5,549,456 A 8/1996 Burrill
5,550,497 A 8/1996 Carobolante
5,550,753 A 8/1996 Tompkins et al.
5,559,418 A 9/1996 Burkhart
5,559,720 A 9/1996 Tompkins
5,559,762 A 9/1996 Sakamoto
5,561,357 A 10/1996 Schroeder
5,562,422 A 10/1996 Ganzon et al.
5,563,759 A 10/1996 Nadd
D375,908 S 11/1996 Schumaker
5,570,481 A 11/1996 Mathis et al.
5,571,000 A 11/1996 Zimmerman
5,577,890 A 11/1996 Nielson et al.
5,580,221 A 12/1996 Triezenberg
5,582,017 A 12/1996 Noji et al.
5,589,753 A 12/1996 Kadah
5,592,062 A 1/1997 Bach
5,598,080 A 1/1997 Jensen
5,601,413 A 2/1997 Langley
5,604,491 A 2/1997 Coonley et al.
5,614,812 A 3/1997 Wagoner
5,616,239 A 4/1997 Wandell et al.
5,618,460 A 4/1997 Fowler
5,622,223 A 4/1997 Vasquez
5,624,237 A 4/1997 Prescott et al.
5,626,464 A 5/1997 Schoenmeyr
5,628,896 A 5/1997 Klingenberger
5,629,601 A 5/1997 Feldstein
5,632,468 A 5/1997 Schoenmeyr
5,633,540 A 5/1997 Moan
5,640,078 A 6/1997 Kou et al.
5,654,504 A 8/1997 Smith et al.
5,654,620 A 8/1997 Langhorst
5,669,323 A 9/1997 Pritchard
5,672,050 A 9/1997 Webber et al.
5,682,624 A 11/1997 Ciochetti
5,690,476 A 11/1997 Miller
5,708,348 A 1/1998 Frey et al.
5,711,483 A 1/1998 Hays
5,712,795 A 1/1998 Layman et al.
5,713,320 A 2/1998 Pfaff et al.
5,727,933 A 3/1998 Laskaris et al.
5,730,861 A 3/1998 Sterghos et al.
5,731,673 A 3/1998 Gilmore
5,736,884 A 4/1998 Ettes et al.
5,739,648 A 4/1998 Ellis et al.
5,744,921 A 4/1998 Makaran
5,754,036 A 5/1998 Walker
5,754,421 A 5/1998 Nystrom
5,767,606 A 6/1998 Bresolin
5,777,833 A 7/1998 Romillon
5,780,992 A 7/1998 Beard
5,791,882 A 8/1998 Stucker
5,796,234 A 8/1998 Vrionis
5,802,910 A 9/1998 Krahn et al.
5,804,080 A 9/1998 Klingenberger
5,808,441 A 9/1998 Nehring
5,814,966 A 9/1998 Williamson
5,818,708 A 10/1998 Wong
5,818,714 A 10/1998 Zou
5,819,848 A 10/1998 Ramusson
5,820,350 A 10/1998 Mantey et al.
5,828,200 A 10/1998 Ligman et al.
5,833,437 A 11/1998 Kurth et al.
5,836,271 A 11/1998 Saski
5,845,225 A 12/1998 Mosher
5,856,783 A 1/1999 Gibb
5,863,185 A 1/1999 Cochimin et al.
5,863,421 A * 1/1999 Peter et al. ..... 210/134
5,883,489 A 3/1999 Konrad
5,892,349 A 4/1999 Bogwicz
5,894,609 A 4/1999 Barnett
5,898,375 A * 4/1999 Patterson ..... 340/612
5,898,958 A 5/1999 Hall
5,906,479 A 5/1999 Hawes
5,907,281 A 5/1999 Miller, Jr. et al.
5,909,352 A 6/1999 Klabunde et al.
5,909,372 A 6/1999 Thybo
5,914,881 A 6/1999 Trachier
5,920,264 A 7/1999 Kim et al.
5,930,092 A 7/1999 Nystrom
5,941,690 A 8/1999 Lin
5,944,444 A 8/1999 Motz et al.
5,945,802 A 8/1999 Konrad
5,946,469 A 8/1999 Chidester
5,947,689 A 9/1999 Schick
5,947,700 A 9/1999 McKain et al.
5,959,534 A 9/1999 Campbell
5,961,291 A 10/1999 Sakagami et al.
5,969,958 A 10/1999 Nielsen
5,973,465 A 10/1999 Rayner
5,973,473 A 10/1999 Anderson
5,977,732 A 11/1999 Matsumoto
5,983,146 A 11/1999 Sarbach
5,986,433 A 11/1999 Peele et al.
5,987,105 A 11/1999 Jenkins et al.
5,991,939 A 11/1999 Mulvey
6,030,180 A 2/2000 Clarey et al.
6,037,742 A 3/2000 Rasussen
6,043,461 A 3/2000 Holling et al.
6,045,331 A 4/2000 Gehm et al.
6,045,333 A 4/2000 Breit
6,046,492 A 4/2000 Machida
6,048,183 A 4/2000 Meza
6,056,008 A 5/2000 Adams et al.
6,059,536 A 5/2000 Stingl
6,065,946 A 5/2000 Lathrop
6,072,291 A 6/2000 Pedersen
6,081,751 A 6/2000 Luo
6,091,604 A 7/2000 Plougsgaard
6,092,992 A 7/2000 Imblum
D429,699 S 8/2000 Davis
D429,700 S 8/2000 Liebig
6,094,764 A 8/2000 Veloskey et al.
6,098,654 A 8/2000 Cohen et al.
6,102,665 A 8/2000 Centers et al.
6,109,050 A * 8/2000 Zakryk ..... 62/238.6
6,110,322 A 8/2000 Teoh et al.
6,116,040 A 9/2000 Stark
6,121,746 A 9/2000 Fisher
6,121,749 A 9/2000 Wills et al.
6,125,481 A 10/2000 Sicilano
6,125,883 A 10/2000 Creps et al.
6,142,741 A 11/2000 Nishihata
6,146,108 A 11/2000 Mullendore
6,150,776 A 11/2000 Potter et al.
6,157,304 A 12/2000 Bennett et al.
6,164,132 A 12/2000 Matulek
6,171,073 B1 1/2001 McKain et al.
6,178,393 B1 1/2001 Irvin
6,184,650 B1 2/2001 Gelbman
6,188,200 B1 2/2001 Maiorano
6,198,257 B1 3/2001 Belehradek et al.

(56) References Cited

U.S. PATENT DOCUMENTS 6,199,224 B1 3/2001 Versland
6,203,282 B1 3/2001 Morin
6,208,112 B1 3/2001 Jensen et al.
6,212,956 B1 4/2001 Donald
6,213,724 B1 4/2001 Haugen
6,216,814 B1 4/2001 Fujita et al.
6,222,355 B1 4/2001 Ohshima
6,227,808 B1 5/2001 McDonough
6,232,742 B1 5/2001 Wacknov
6,236,177 B1 5/2001 Zick
6,238,188 B1 5/2001 Lifson
6,247,429 B1 6/2001 Hara
6,249,435 B1 6/2001 Vicente et al.
6,251,285 B1 6/2001 Clochetti
6,253,227 B1 6/2001 Tompkins
D445,405 S 7/2001 Schneider
6,254,353 B1 7/2001 Polo
6,257,304 B1 7/2001 Jacobs et al.
6,257,833 B1 7/2001 Bates
6,259,617 B1 7/2001 Wu
6,264,431 B1 7/2001 Trizenberg
6,264,432 B1 7/2001 Kilayko et al.
6,280,611 B1 8/2001 Henkin et al.
6,282,370 B1 8/2001 Cline et al.
6,298,721 B1 10/2001 Schuppe et al.
6,299,414 B1 10/2001 Schoenmeyr
6,299,699 B1 10/2001 Porat et al.
6,318,093 B2 11/2001 Gaudet et al.
6,320,348 B1 11/2001 Kadah
6,326,752 B1 12/2001 Jensen et al.
6,329,784 B1 12/2001 Puppin
6,330,525 B1 12/2001 Hays
6,342,841 B1 1/2002 Stingl
6,349,268 B1 2/2002 Ketonen et al.
6,350,105 B1 2/2002 Kobayashi et al.
6,351,359 B1 2/2002 Jager
6,354,805 B1 3/2002 Moeller
6,356,464 B1 3/2002 Balakrishnan
6,356,853 B1 3/2002 Sullivan
6,362,591 B1 3/2002 Moberg
6,364,620 B1 4/2002 Fletcher et al.
6,364,621 B1 4/2002 Yamauchi
6,366,053 B1 4/2002 Belehradek
6,366,481 B1 4/2002 Balakrishnan
6,369,463 B1 4/2002 Maiorano
6,373,204 B1 4/2002 Peterson
6,373,728 B1 4/2002 Aarestrup
6,374,854 B1 4/2002 Acosta
6,375,430 B1 4/2002 Eckert et al.
6,380,707 B1 4/2002 Rosholm
6,388,642 B1 5/2002 Cotis
6,390,781 B1 5/2002 McDonough
6,406,265 B1 6/2002 Hahn
6,411,481 B1 6/2002 Seubert
6,415,808 B2 7/2002 Joshi
6,416,295 B1 7/2002 Nagai
6,426,633 B1 7/2002 Thybo
6,443,715 B1 9/2002 Mayleben et al.
6,445,565 B1 9/2002 Toyoda et al.
6,447,446 B1 9/2002 Smith et al.
6,448,713 B1 9/2002 Farkas et al.
6,450,771 B1 9/2002 Centers
6,462,971 B1 10/2002 Balakrishnan et al.
6,464,464 B2 10/2002 Sabini
6,468,042 B2 10/2002 Moller
6,468,052 B2 10/2002 McKain et al.
6,474,949 B1 11/2002 Arai
6,481,973 B1 11/2002 Struthers
6,483,278 B2 11/2002 Harvest
6,483,378 B2 11/2002 Blodgett
6,490,920 B1 12/2002 Netzer
6,493,227 B2 12/2002 Nielson et al.
6,496,392 B2 12/2002 Odel
6,499,961 B1 12/2002 Wyatt
6,501,629 B1 12/2002 Mariott
6,503,063 B1 1/2003 Brunsell
6,504,338 B1 1/2003 Eichorn
6,520,010 B1 2/2003 Bergveld
6,522,034 B1 2/2003 Nakayama
6,523,091 B2 2/2003 Tirumala
6,527,518 B2 3/2003 Ostrowski
6,534,940 B2 3/2003 Bell et al.
6,534,947 B2 3/2003 Johnson
6,537,032 B1 3/2003 Horiuchi
6,538,908 B2 3/2003 Balakrishnan et al.
6,539,797 B2 4/2003 Livingston
6,543,940 B2 4/2003 Chu
6,548,976 B2 4/2003 Jensen
6,564,627 B1 5/2003 Sabini
6,570,778 B2 5/2003 Lipo et al.
6,571,807 B2 6/2003 Jones
6,590,188 B2 7/2003 Cline
6,591,697 B2 7/2003 Henyan
6,591,863 B2 7/2003 Ruschell
6,595,051 B1 7/2003 Chandler, Jr.
6,595,762 B2 7/2003 Khanwilkar et al.
6,604,909 B2 8/2003 Schoenmeyr
6,607,360 B2 8/2003 Fong
6,616,413 B2 9/2003 Humphries
6,623,245 B2 9/2003 Meza et al.
6,626,840 B2 9/2003 Drzewiecki
6,628,501 B2 9/2003 Toyoda
6,632,072 B2 10/2003 Lipscomb et al.
6,636,135 B1 10/2003 Vetter
6,638,023 B2 10/2003 Scott
D482,664 S 11/2003 Hunt
6,643,153 B2 11/2003 Balakrishnan
6,651,900 B1 11/2003 Yoshida
6,663,349 B1 12/2003 Discenzo et al.
6,665,200 B2 12/2003 Goto
6,672,147 B1 1/2004 Mazet
6,675,912 B2 1/2004 Carrier
6,676,382 B2 1/2004 Leighton et al.
6,676,831 B2 1/2004 Wolfe
6,687,141 B2 2/2004 Odell
6,687,923 B2 2/2004 Dick
6,690,250 B2 2/2004 Moller
6,696,676 B1 2/2004 Graves et al.
6,700,333 B1 3/2004 Hirshi et al.
6,709,240 B1 3/2004 Schmalz
6,709,241 B2 3/2004 Sabini
6,709,575 B1 3/2004 Verdegan
6,715,996 B2 4/2004 Moeller
6,717,318 B1 4/2004 Mathiasssen
6,732,387 B1 5/2004 Waldron
6,737,905 B1 5/2004 Noda
D490,726 S 6/2004 Eungprabhanth
6,742,387 B2 6/2004 Hamamoto
6,747,367 B2 6/2004 Cline et al.
6,761,067 B1 7/2004 Capano
6,768,279 B1 7/2004 Skinner
6,770,043 B1 8/2004 Kahn
6,774,664 B2 8/2004 Godbersen
6,776,038 B1 8/2004 Horton et al.
6,776,584 B2 8/2004 Sabini et al.
6,778,868 B2 8/2004 Imamura et al.
6,779,205 B2 8/2004 Mulvey
6,779,950 B1 8/2004 Hutchins
6,782,309 B2 8/2004 Laflamme
6,783,328 B2 8/2004 Lucke
6,789,024 B1 9/2004 Kochan, Jr. et al.
6,794,921 B2 9/2004 Abe
6,797,164 B2 9/2004 Leaverton
6,798,271 B2 9/2004 Swize
6,806,677 B2 10/2004 Kelly et al.
6,837,688 B2 1/2005 Kimberlin et al.
6,842,117 B2 1/2005 Keown
6,847,130 B1 1/2005 Belehradek et al.
6,847,854 B2 1/2005 Discenzo
6,854,479 B2 2/2005 Harwood
6,863,502 B2 3/2005 Bishop et al.
6,867,383 B1 3/2005 Currier
6,875,961 B1 4/2005 Collins
6,882,165 B2 4/2005 Ogura

(56) References Cited

U.S. PATENT DOCUMENTS 6,884,022 B2 4/2005 Albright
D504,900 S 5/2005 Wang
D505,429 S 5/2005 Wang
6,888,537 B2 5/2005 Benson
6,895,608 B2 5/2005 Goettl
6,900,736 B2 5/2005 Crumb
6,906,482 B2 6/2005 Shimizu
D507,243 S 7/2005 Miller
6,914,793 B2 7/2005 Balakrishnan
6,922,348 B2 7/2005 Nakajima
6,925,823 B2 8/2005 Lifson
6,933,693 B2 8/2005 Schuchmann
6,941,785 B2 9/2005 Haynes et al.
6,943,325 B2 9/2005 Pittman
D511,530 S 11/2005 Wang
D512,026 S 11/2005 Nurmi
6,965,815 B1 11/2005 Tompkins et al.
6,966,967 B2 11/2005 Curry
D512,440 S 12/2005 Wang
6,973,794 B2 12/2005 Street
6,973,974 B2 12/2005 McLoughlin et al.
6,976,052 B2 12/2005 Tompkins et al.
D513,737 S 1/2006 Riley
6,981,399 B1 1/2006 Nybo
6,981,402 B2 1/2006 Bristol
6,984,158 B2 1/2006 Satoh
6,989,649 B2 1/2006 Melhorn
6,993,414 B2 1/2006 Shah
6,998,807 B2 2/2006 Phillips et al.
6,998,977 B2 2/2006 Gregori et al.
7,005,818 B2 2/2006 Jensen
7,012,394 B2 3/2006 Moore et al.
7,015,599 B2 3/2006 Gull et al.
7,040,107 B2 5/2006 Lee et al.
7,042,192 B2 5/2006 Mehlhorn
7,050,278 B2 5/2006 Poulsen
7,055,189 B2 6/2006 Goettl
7,070,134 B1 7/2006 Hoyer
7,077,781 B2 7/2006 Ishikawa
7,080,508 B2 7/2006 Stavale
7,081,728 B2 7/2006 Kemp
7,083,392 B2 8/2006 Meza
7,089,607 B2 8/2006 Barnes et al.
7,100,632 B2 9/2006 Harwood
7,102,505 B2 9/2006 Kates
7,112,037 B2 9/2006 Sabini et al.
7,114,926 B2 10/2006 Oshita
7,117,120 B2 10/2006 Beck et al.
7,141,210 B2 11/2006 Bell
7,142,932 B2 11/2006 Spria et al.
D533,512 S 12/2006 Nakashima
7,163,380 B2 1/2007 Jones
7,172,366 B1 2/2007 Bishop, Jr.
7,178,179 B2 2/2007 Barnes
7,183,741 B2 2/2007 Mehlhorn
7,195,462 B2 3/2007 Nybo et al.
7,201,563 B2 4/2007 Studebaker
7,221,121 B2 5/2007 Skaug
7,244,106 B2 7/2007 Kallaman
7,245,105 B2 7/2007 Joo
7,259,533 B2 8/2007 Yang et al.
7,264,449 B1 9/2007 Harned et al.
7,281,958 B2 10/2007 Schuttler et al.
7,292,898 B2 11/2007 Clark et al.
7,307,538 B2 12/2007 Kochan, Jr.
7,309,216 B1 12/2007 Spadola et al.
7,318,344 B2 1/2008 Heger
D562,349 S 2/2008 Bulter
7,327,275 B2 2/2008 Brochu
7,339,126 B1 3/2008 Niedermeyer
D567,189 S 4/2008 Stiles, Jr.
7,352,550 B2 4/2008 Mladenik
7,375,940 B1 5/2008 Bertrand
7,388,348 B2 6/2008 Mattichak
7,407,371 B2 8/2008 Leone
7,427,844 B2 9/2008 Mehlhorn
7,429,842 B2 9/2008 Schulman et al.
7,437,215 B2 10/2008 Anderson et al.
D582,797 S 12/2008 Fraser
D583,828 S 12/2008 Li
7,458,782 B1 12/2008 Spadola et al.
7,459,886 B1 12/2008 Potanin et al.
7,484,938 B2 2/2009 Allen
7,514,884 B2 * 4/2009 Potucek et al. ..... 315/322
7,516,106 B2 4/2009 Ehlers
7,525,280 B2 4/2009 Fagan et al.
7,528,579 B2 5/2009 Pacholok et al.
7,542,251 B2 6/2009 Ivankovic
7,542,252 B2 6/2009 Chan et al.
7,572,108 B2 8/2009 Koehl
7,612,510 B2 11/2009 Koehl
7,612,529 B2 11/2009 Kochan, Jr.
7,623,986 B2 11/2009 Miller
7,641,449 B2 1/2010 Iimura et al.
7,652,441 B2 1/2010 Ho
7,686,587 B2 3/2010 Koehl
7,686,589 B2 3/2010 Stiles et al.
7,690,897 B2 4/2010 Branecky
7,700,887 B2 4/2010 Niedermeyer
7,704,051 B2 4/2010 Koehl
7,727,181 B2 6/2010 Rush
7,739,733 B2 6/2010 Szydlo
7,746,063 B2 6/2010 Sabini et al.
7,751,159 B2 7/2010 Koehl
7,755,318 B1 7/2010 Panosh
7,775,327 B2 8/2010 Abraham
7,777,435 B2 8/2010 Aguilar
7,780,406 B2 * 8/2010 Sloan et al. ..... 415/206
7,788,877 B2 9/2010 Andras
7,795,824 B2 9/2010 Shen et al.
7,808,211 B2 10/2010 Pacholok et al.
7,815,420 B2 10/2010 Koehl
7,821,215 B2 10/2010 Koehl
7,845,913 B2 12/2010 Stiles et al.
7,854,597 B2 12/2010 Stiles et al.
7,857,600 B2 12/2010 Koehl
7,874,808 B2 1/2011 Stiles
7,878,766 B2 2/2011 Meza
7,900,308 B2 3/2011 Erlich
7,925,385 B2 4/2011 Stavale et al.
7,931,447 B2 4/2011 Levin et al.
7,945,411 B2 5/2011 Kernan et al.
7,976,284 B2 7/2011 Koehl
7,983,877 B2 7/2011 Koehl
7,990,091 B2 8/2011 Koehl
8,011,895 B2 9/2011 Ruffo
8,019,479 B2 * 9/2011 Stiles et al. ..... 700/282
8,032,256 B1 10/2011 Wolf et al.
8,043,070 B2 10/2011 Stiles
8,049,464 B2 11/2011 Muntermann
8,098,048 B2 1/2012 Hoff
8,104,110 B2 1/2012 Caudill et al.
8,126,574 B2 2/2012 Discenzo et al.
8,133,034 B2 3/2012 Mehlhorn et al.
8,134,336 B2 3/2012 Michalske et al.
8,177,520 B2 5/2012 Mehlhorn
8,281,425 B2 10/2012 Cohen
8,303,260 B2 11/2012 Stavale et al.
8,313,306 B2 11/2012 Stiles et al.
8,316,152 B2 11/2012 Geltner et al.
8,317,485 B2 11/2012 Meza et al.
8,337,166 B2 12/2012 Meza et al.
8,380,355 B2 2/2013 Mayleben et al.
8,405,346 B2 3/2013 Trigiani
8,405,361 B2 3/2013 Richards et al.
8,444,394 B2 5/2013 Koehl
8,465,262 B2 6/2013 Stiles et al.
8,469,675 B2 6/2013 Stiles et al.
8,480,373 B2 7/2013 Stiles et al.
8,500,413 B2 8/2013 Stiles et al.
8,540,493 B2 9/2013 Koehl
8,547,065 B2 10/2013 Trigiani
8,573,952 B2 11/2013 Stiles et al.
8,579,600 B2 11/2013 Vijayakumar et al.

(56) References Cited

U.S. PATENT DOCUMENTS 8,602,745 B2 12/2013 Stiles
8,641,383 B2 2/2014 Meza
8,641,385 B2 2/2014 Koehl
8,669,494 B2 3/2014 Tran
8,756,991 B2 6/2014 Edwards
8,763,315 B2 7/2014 Hartman
8,774,972 B2 7/2014 Rusnak
2001/0002238 A1 5/2001 McKain
2001/0029407 A1 10/2001 Tompkins
2001/0041139 A1 11/2001 Sabini et al.
2002/0000789 A1 1/2002 Haba
2002/0002989 A1 1/2002 Jones
2002/0010839 A1 1/2002 Tirumalal et al.
2002/0018721 A1 2/2002 Kobayashi
2002/0032491 A1 3/2002 Imamura et al.
2002/0035403 A1 3/2002 Clark et al.
2002/0050490 A1 5/2002 Pittman et al.
2002/0070611 A1 6/2002 Cline et al.
2002/0070875 A1 6/2002 Crumb
2002/0082727 A1 6/2002 Laflamme et al.
2002/0089236 A1 7/2002 Cline et al.
2002/0093306 A1 7/2002 Johnson
2002/0101193 A1 8/2002 Farkas
2002/0111554 A1 8/2002 Drzewiecki
2002/0131866 A1 9/2002 Phillips
2002/0136642 A1 9/2002 Moller
2002/0150476 A1 10/2002 Lucke
2002/0163821 A1 11/2002 Odell
2002/0172055 A1 11/2002 Balakrishnan
2002/0176783 A1 11/2002 Moeller
2002/0190687 A1 12/2002 Bell et al.
2003/0000303 A1 1/2003 Livingston
2003/0017055 A1 1/2003 Fong
2003/0030954 A1 2/2003 Bax et al.
2003/0034284 A1 2/2003 Wolfe
2003/0034761 A1 2/2003 Goto
2003/0048646 A1 3/2003 Odell
2003/0061004 A1 3/2003 Discenzo
2003/0063900 A1 4/2003 Wang et al.
2003/0099548 A1 5/2003 Meza
2003/0106147 A1 6/2003 Cohen et al.
2003/0174450 A1 9/2003 Nakajima et al.
2003/0186453 A1 10/2003 Bell
2003/0196942 A1 10/2003 Jones
2004/0000525 A1 1/2004 Hornsby
2004/0006486 A1 1/2004 Schmidt et al.
2004/0009075 A1 1/2004 Meza
2004/0013531 A1 1/2004 Curry et al.
2004/0016241 A1 1/2004 Street et al.
2004/0025244 A1 2/2004 Lloyd et al.
2004/0055363 A1 3/2004 Bristol
2004/0062658 A1 4/2004 Beck et al.
2004/0064292 A1 4/2004 Beck
2004/0071001 A1 4/2004 Balakrishnan
2004/0080325 A1 4/2004 Ogura
2004/0080352 A1 4/2004 Noda
2004/0090197 A1 5/2004 Schuchmann
2004/0095183 A1 5/2004 Swize
2004/0116241 A1 6/2004 Ishikawa
2004/0117330 A1 6/2004 Ehlers et al.
2004/0118203 A1 6/2004 Heger
2004/0149666 A1 8/2004 Leaverton
2004/0205886 A1 10/2004 Goettel
2004/0213676 A1 10/2004 Phillips
2004/0265134 A1 12/2004 Iimura et al.
2005/0050908 A1 3/2005 Lee et al.
2005/0069421 A1* 3/2005 Basora ..... 417/250
2005/0086957 A1 4/2005 Lifson
2005/0095150 A1 5/2005 Leone et al.
2005/0097665 A1 5/2005 Goettel
2005/0123408 A1* 6/2005 Koehl ..... 417/53
2005/0133088 A1 6/2005 Bologeorges
2005/0137720 A1 6/2005 Spira et al.
2005/0156568 A1 7/2005 Yueh
2005/0158177 A1 7/2005 Mehlhorn
2005/0167345 A1 8/2005 De Wet et al.
2005/0170936 A1 8/2005 Quinn
2005/0180868 A1 8/2005 Miller
2005/0190094 A1 9/2005 Andersen
2005/0193485 A1 9/2005 Wolfe
2005/0195545 A1 9/2005 Mladenik
2005/0226731 A1* 10/2005 Mehlhorn et al. ..... 417/44.11
2005/0235732 A1 10/2005 Rush
2005/0248310 A1 11/2005 Fagan et al.
2005/0260079 A1 11/2005 Allen
2005/0281679 A1 12/2005 Niedermeyer
2005/0281681 A1 12/2005 Anderson
2006/0045750 A1 3/2006 Stiles
2006/0045751 A1 3/2006 Beckman et al.
2006/0078435 A1 4/2006 Burza
2006/0078444 A1 4/2006 Sacher
2006/0090255 A1 5/2006 Cohen
2006/0093492 A1 5/2006 Janesky
2006/0127227 A1 6/2006 Mehlhorn
2006/0138033 A1 6/2006 Hoal et al.
2006/0146462 A1 7/2006 McMillian et al.
2006/0169322 A1 8/2006 Torkelson
2006/0204367 A1 9/2006 Meza
2006/0226997 A1 10/2006 Kochan, Jr.
2006/0235573 A1 10/2006 Guion
2006/0269426 A1 11/2006 Llewellyn
2007/0001635 A1 1/2007 Ho
2007/0041845 A1 2/2007 Freudenberger
2007/0061051 A1 3/2007 Maddox
2007/0080660 A1 4/2007 Fagan et al.
2007/0093920 A1* 4/2007 Tarpo et al. ..... 700/65
2007/0113647 A1 5/2007 Mehlhorn
2007/0114162 A1* 5/2007 Stiles et al. ..... 210/137
2007/0124321 A1 5/2007 Szydlo
2007/0154319 A1 7/2007 Stiles
2007/0154320 A1 7/2007 Stiles
2007/0154321 A1 7/2007 Stiles
2007/0154322 A1* 7/2007 Stiles et al. ..... 417/44.1
2007/0154323 A1 7/2007 Stiles
2007/0160480 A1 7/2007 Ruffo
2007/0163929 A1 7/2007 Stiles
2007/0183902 A1 8/2007 Stiles
2007/0187185 A1 8/2007 Abraham et al.
2007/0188129 A1 8/2007 Kochan, Jr.
2007/0212210 A1 9/2007 Kernan et al.
2007/0212229 A1 9/2007 Stavale et al.
2007/0212230 A1 9/2007 Stavale et al.
2007/0258827 A1 11/2007 Gierke
2008/0003114 A1 1/2008 Levin et al.
2008/0031751 A1 2/2008 Littwin et al.
2008/0031752 A1 2/2008 Littwin et al.
2008/0039977 A1 2/2008 Clark et al.
2008/0041839 A1 2/2008 Tran
2008/0063535 A1 3/2008 Koehl
2008/0095638 A1 4/2008 Branecky
2008/0095639 A1 4/2008 Bartos
2008/0131286 A1 6/2008 Koehl
2008/0131289 A1 6/2008 Koehl
2008/0131291 A1 6/2008 Koehl
2008/0131294 A1 6/2008 Koehl
2008/0131295 A1 6/2008 Koehl
2008/0131296 A1 6/2008 Koehl
2008/0140353 A1 6/2008 Koehl
2008/0152508 A1 6/2008 Meza
2008/0168599 A1 7/2008 Caudill
2008/0181785 A1 7/2008 Koehl
2008/0181786 A1 7/2008 Meza
2008/0181787 A1 7/2008 Koehl
2008/0181788 A1 7/2008 Meza
2008/0181789 A1 7/2008 Koehl
2008/0181790 A1 7/2008 Meza
2008/0189885 A1 8/2008 Erlich
2008/0229819 A1 9/2008 Mayleben et al.
2008/0249352 A1* 10/2008 Dancu ..... 600/36
2008/0260540 A1* 10/2008 Koehl ..... 417/44.2
2008/0288115 A1 11/2008 Rusnak et al.
2008/0298978 A1 12/2008 Schulman et al.
2009/0014044 A1 1/2009 Hartman
2009/0038696 A1 2/2009 Levin et al.

(56) References Cited

U.S. PATENT DOCUMENTS

| | | | |
|---|---|---|---|
| 2009/0052281 | A1 | 2/2009 | Nybo |
| 2009/0104044 | A1 | 4/2009 | Koehl |
| 2009/0129942 | A1* | 5/2009 | Dorado et al. ..... 417/43 |
| 2009/0143917 | A1 | 6/2009 | Uy et al. |
| 2009/0204237 | A1 | 8/2009 | Sustaeta et al. |
| 2009/0204267 | A1 | 8/2009 | Sustaeta et al. |
| 2009/0208345 | A1 | 8/2009 | Moore et al. |
| 2009/0210081 | A1 | 8/2009 | Sustaeta et al. |
| 2009/0269217 | A1 | 10/2009 | Vijayakumar |
| 2010/0154534 | A1 | 6/2010 | Hampton |
| 2010/0166570 | A1 | 7/2010 | Hampton |
| 2010/0197364 | A1 | 8/2010 | Lee |
| 2010/0303654 | A1 | 12/2010 | Petersen et al. |
| 2010/0306001 | A1 | 12/2010 | Discenzo |
| 2010/0312398 | A1 | 12/2010 | Kidd et al. |
| 2011/0036164 | A1 | 2/2011 | Burdi |
| 2011/0044823 | A1 | 2/2011 | Stiles |
| 2011/0052416 | A1 | 3/2011 | Stiles |
| 2011/0077875 | A1 | 3/2011 | Tran |
| 2011/0084650 | A1 | 4/2011 | Kaiser et al. |
| 2011/0110794 | A1 | 5/2011 | Mayleben et al. |
| 2011/0280744 | A1 | 11/2011 | Ortiz et al. |
| 2011/0311370 | A1 | 12/2011 | Sloss et al. |
| 2012/0020810 | A1 | 1/2012 | Stiles, Jr. et al. |
| 2012/0100010 | A1 | 4/2012 | Stiles et al. |

FOREIGN PATENT DOCUMENTS

| | | | |
|---|---|---|---|
| AU | 2007332716 | A1 | 6/2008 |
| AU | 2007332769 | A1 | 6/2008 |
| CA | 2548437 | A1 | 6/2005 |
| CA | 2731482 | A1 | 6/2005 |
| CA | 2517040 | A1 | 2/2006 |
| CA | 2528580 | A1 | 5/2007 |
| CA | 2672410 | A1 | 6/2008 |
| CA | 2672459 | A1 | 6/2008 |
| CN | 101165352 | | 4/2008 |
| DE | 3023463 | A1 | 2/1981 |
| DE | 2946049 | A1 | 5/1981 |
| DE | 29612980 | U1 | 10/1996 |
| DE | 19736079 | A1 | 8/1997 |
| DE | 19645129 | A1 | 5/1998 |
| DE | 29724347 | U1 | 11/2000 |
| DE | 10231773 | A1 | 2/2004 |
| DE | 19938490 | B4 | 4/2005 |
| EP | 0150068 | A2 | 7/1985 |
| EP | 0226858 | A1 | 7/1987 |
| EP | 0246769 | A2 | 11/1987 |
| EP | 0306814 | A1 | 3/1989 |
| EP | 0314249 | A1 | 3/1989 |
| EP | 0709575 | A1 | 5/1996 |
| EP | 0735273 | A1 | 10/1996 |
| EP | 0833436 | A2 | 4/1998 |
| EP | 0831188 | A3 | 2/1999 |
| EP | 0978657 | A1 | 2/2000 |
| EP | 1134421 | A1 | 9/2001 |
| EP | 0916026 | | 5/2002 |
| EP | 1315929 | | 6/2003 |
| EP | 1585205 | A2 | 10/2005 |
| EP | 1630422 | A2 | 3/2006 |
| EP | 1698815 | A1 | 9/2006 |
| EP | 1995462 | A2 | 11/2008 |
| EP | 2102503 | A2 | 9/2009 |
| EP | 2122171 | A1 | 11/2009 |
| EP | 2122172 | A1 | 11/2009 |
| EP | 2273125 | A1 | 1/2011 |
| FR | 2529965 | A1 | 1/1984 |
| FR | 2703409 | A1 | 10/1994 |
| GB | 2124304 | A1 | 2/1984 |
| JP | 55072678 | A | 5/1980 |
| JP | 5010270 | A | 1/1993 |
| MX | 2009006258 | A1 | 12/2009 |
| WO | 98/04835 | A1 | 2/1998 |
| WO | 00/42339 | A1 | 7/2000 |
| WO | 01/27508 | A1 | 4/2001 |
| WO | 01/47099 | A1 | 6/2001 |
| WO | 02/18826 | A1 | 3/2002 |
| WO | 03/025442 | A1 | 3/2003 |
| WO | 03/099705 | A2 | 12/2003 |
| WO | 2004/006416 | A1 | 1/2004 |
| WO | 2004/073772 | A1 | 9/2004 |
| WO | 2004/088694 | A1 | 10/2004 |
| WO | 2005/011473 | A1 | 2/2005 |
| WO | 2005011473 | A3 | 2/2005 |
| WO | 2005/055694 | A1 | 6/2005 |
| WO | 2005111473 | A2 | 11/2005 |
| WO | 2006/069568 | A1 | 7/2006 |
| WO | 2008/073329 | A1 | 6/2008 |
| WO | 2008/073330 | A1 | 6/2008 |
| WO | 2008073386 | A1 | 6/2008 |
| WO | 2008073413 | A1 | 6/2008 |
| WO | 2008073418 | A1 | 6/2008 |
| WO | 2008073433 | A1 | 6/2008 |
| WO | 2008073436 | A1 | 6/2008 |
| ZA | 200506869 | | 5/2006 |
| ZA | 200509691 | | 11/2006 |
| ZA | 200904747 | | 7/2010 |
| ZA | 200904849 | | 7/2010 |
| ZA | 200904850 | | 7/2010 |

OTHER PUBLICATIONS

Glentronics Home Page, dated 2007. 2 pages.

Goulds Pumps SPBB/SPBB2 Battery Backup Sump Pumps, dated 2007.

ITT Red Jacket Water Products Installation, Operation and Parts Manual, dated 2009. 8 pages.

Liberty Pumps PC-Series Brochure, dated 2010. 2 pages.

"Lift Station Level Control" by Joe Evans PhD, www.pumped101.com, dated Sep. 2007. 5 pages.

The Basement Watchdog A/C-D/C Battery Backup Sump Pump System Instruction Manual and Safety Warnings, dated 2010. 20 pages.

The Basement Watchdog Computer Controlled A/C-D/C Sump Pump System Instruction Manual, dated 2010. 17 pages, date Nov. 2010.

ITT Red Jacket Water Products RJBB/RJBB2 Battery Backup Sump Pumps; May 2007, 2 pages.

54DX18-STMICROELECTRONICS; "AN1946—Sensorless BLOC Motor Control & BEMF Sampling Methods with ST7MC;" 2007; pp. 1-35; Civil Action 5:11-cv-004590.

54DX19-STMICROELECTRONICS; "AN1276 BLOC Motor Start Routine for ST72141 Microcontroller;" 2000; pp. 1-18; cited in Civil Action 5:11-cv-004590.

54DX22-Danfoss; "VLT 8000 Aqua Instruction Manual;" pp. 1-35; cited in Civil Action 5:11-cv-004590; Dec. 2, 2011.

54DX23-Commander; "Commander SE Advanced User Guide;" Nov. 2002; pp. 1-190; cited in Civil Action 5:11-cv-004590.

540X30-Sabbagh et al.; "A Model for OptimaL.Control of Pumping Stations in Irrigation Systems;" Jul. 1988; NL pp. 119-133; Civil Action 5:11-cv-004590.

540X33-PENTAIR; "IntelliTouch Owner's Manual Set-Up & Programming;" May 22, 2003; Sanford, NC; pp. 1-61; cited in Civil Action 5:11-cv-004590.

540X34-PENTAIR; "Compool3800 Pool-Spa Control System Installation & Operating Instructions;" Nov. 7, 1997; pp. 1-45; cited in Civil Action 5:11-cv-004590.

5540X36-Hayward; "Pro-Series High-Rate Sand Filter Owner's Guide;" 2002; Elizabeth, NJ; pp. 1-5; cited in Civil Action 5:11-cv-00459D.

540X37-Danfoss; "VLT 8000 Aqua Fact Sheet;" Jan. 2002; pp. 1-3; cited in Civil Action 5:11-cv-004590.

540X38-0ANFOSS; "VLT 6000 Series Installation, Operation & Maintenance Manual;" Mar. 2000; pp. 1-118; cited in Civil Action 5:11-cv-004590.

9PX-42-Hayward Pool Systems; "Hayward EcoStar & EcoStar SVRS Variable Speed Pumps Brochure;" Civil Action 5:11-cv-00459D; 2010, 3 pages.

(56) References Cited

OTHER PUBLICATIONS 205-24-Exh23-Piaintiff's Preliminary Disclosure of Asserted Claims and Preliminary Infringement Contentions; cited in Civil Action 5:11-cv-00459; Feb. 21, 2012, 1 page.
9PX10-PENTAIR; "IntelliPro VS+SVRS Intelligent Variable Speed Pump;" 2011; pp. 1-6; cited in Civil Action 5:11-cv-00459D.
Robert S. Carrow; "Electrician's Technical Reference-Variable Frequency Drives;" 2001; pp. 1-194.
Baldor; "Balder Motors and Drives Series 14 Vector Drive Control Operating & Technical Manual;" Mar. 22, 1992; pp. 1-92.
Baldor; "Baldor Series 10 Inverter Control: Installation and Operating Manual"; Feb. 2000; pp. 1-74.
Dinverter; "Dinverter 2B User Guide;" Nov. 1998; pp. 1-94.
Danfoss; "VLT8000 Aqua Instruction Manual;" Apr. 16, 2004; pp. 1-71.
Compool; "Compool CP3800 Pool-Spa Control System Installation and Operating Instructions;" Nov. 7, 1997; pp. 1-45.
Hayward; "Hayward Pro-Series High-Rate Sand Filter Owner's Guide," 2002; pp. 1-4.
Danfoss; "Danfoss VLT 6000 Series Adjustable Frequency Drive Installation, Operation and Maintenance Manual;" Mar. 2000; pp. 1-118.
Load Controls Incorporated, product web pages including Affidavit of Christopher Butler of Internet Archive attesting to the authenticity of the web pages, dated Apr. 17, 2013, 19 pages.
Cliff Wyatt, "Monitoring Pumps," World Pumps, vol. 2004, Issue 459, Dec. 2004, pp. 17-21.
Danfoss, VLT® Aqua Drive, "The ultimate solution for Water, Wastewater, & Irrigation", May 2007, pp. 1-16.
Danfoss, Salt Drive Systems, "Increase oil & gas production, Minimize energy consumption", copyright 2011, pp. 1-16.
Schlumberger Limited, Oilfield Glossary, website Search Results for "pump-off", copyright 2014, 1 page.
Pent Air; "Pentair IntelliTouch Operating Manual;" May 22, 2003; pp. 1-60.
Allen-Bradley; "1336 Plus II Adjustable Frequency AC Drive with Sensorless Vector User Manual;" Sep. 2005; pp. 1-212.
Per Brath—Danfoss Drives A/S, Towards Autonomous Control of HVAC Systems, thesis with translation of Introduction, Nov. 1999, 216 pages.
Waterworld, New AC Drive Series Targets Water, Wastewater Applications, magazine, Jul. 2002, 5 pages, vol. 18, Issue 7.
Texas Instruments, TMS320F/C240 DSP Controllers Peripheral Library and Specific Devices, Reference Guide, Nov. 2002, 485 pages, printed in U.S.A.
Jan Eric Thorsen—Danfoss, Technical Paper—Dynamic simulation of DH House Stations, presented by 7. Dresdner Femwärme-Kolloquium Sep. 2002, 10 pages, published in Euro Heat & Power Jun. 2003.
Texas Instruments, Electronic Copy of TMS320F/C240 DSP Controllers Reference Guide, Peripheral Library and Specific Devices, Jun. 1999, 474 pages.
Decision on Appeal issued in Appeal No. 2015-007909, regarding *Hayward Industries, Inc.* v. *Pentair Ltd.*, mailed Apr. 1, 2016, 19 pages.
Bibliographic Data Sheet—U.S. Appl. No. 10/730,747 Applicant: Robert M. Koehl Reasons for Inclusion: Printed publication US 2005/0123408 A1 for U.S. Appl. No. 10/730,747 has incorrect filing date, 1 pages.
Shabnam Moghanrabi; "Better, Stronger, Faster;" Pool & Spa News, Sep. 3, 2004; pp. 1-5; www/poolspanews.com.
Grundfos Pumps Corporation; "The New Standard in Submersible Pumps;" Brochure; pp. 1-8; Jun. 1999; Fresno, CA USA.
Grundfos Pumps Corporation; "Grundfos SQ/SQE Data Book;" pp. 1-39; Jun. 1999; Fresno, CA USA.
Goulds Pumps; "Balanced Flow System Brochure;" pp. 1-4; 2001.
Goulds Pumps; "Balanced Flow Submersible System Installation, Operation & Trouble-Shooting Manual;" pp. 1-9; 2000; USA.
Goulds Pumps; "Balanced Flow Submersible System Informational Seminar;" pp. 1-22; Undated.
Goulds Pumps; "Balanced Flow System Variable Speed Submersible Pump" Specification Sheet; pp. 1-2; Jan. 2000; USA.
Goulds Pumps; "Hydro-Pro Water System Tank Installation, Operation & Maintenance Instructions;" pp. 1-30; Mar. 31, 2001; Seneca Falls, NY USA.
Goulds Pumps; "Pumpsmart Control Solutions" Advertisement from Industrial Equipment News; Aug. 2002; New York, NY USA, 1 page.
Goulds Pumps; "Model BFSS List Price Sheet;" Feb. 5, 2001.
Goulds Pumps; "Balanced Flow System Model BFSS Variable Speed Submersible Pump System" Brochure; pp. 1-4; Jan. 2001; USA.
Goulds Pumps; "Balanced Flow System . . . The Future of Constant Pressure Has Arrived;" Undated Advertisement; Residential water system 8 pages.
Amtrol Inc.; "AMTROL Unearths the Facts About Variable Speed Pumps and Constant Pressure Valves;" pp. 1-5; Mar. 2002; West Warwick, RI USA.
Franklin Electric; "CP Water-Subdrive 75 Constant Pressure Controller" Product Data Sheet; May 2001; Bluffton, IN USA.
Franklin Electric; "Franklin Aid, Subdrive 75: You Made It Better;" vol. 20, No. 1; pp. 1-2; Jan./Feb. 2002; www.franklin-electric.com.
Grundfos; "SQ/SQE—A New Standard in Submersible Pumps;" Undated Brochure; pp. 1-14; Denmark.
Grundfos; "JetPaq—The Complete Pumping System;" Undated Brochure; pp. 1-4; Clovis, CA USA.
Email Regarding Grundfos' Price Increases/SQ/SQE Curves; pp. 1-7; Dec 19, 2001.
F.E. Myers; "Featured Product: F.E. Myers Introducts Revolutionary Constant Pressure Water System;" pp. 1-8; Jun. 28, 2000; Ashland, OH USA.
"Water Pressure Problems" Published Article; The American Well Owner; No. 2, Jul. 2000, 1 page.
Bjarke Soerensen; "Have You Chatted With Your Pump Today?" Undated Article Reprinted with Permission of Grundfos Pump University; pp. 1-2; USA.
"Understanding Constant Pressure Control;" pp. 1-3; Nov. 1, 1999.
SJE-Rhombus; "Variable Frequency Drives for Constant Pressure Control;" Aug. 2008; pp. 1-4; Detroit Lakes, MN USA.
SJE-Rhombus; "Constant Pressure Controller for Submersible Well Pumps;" Jan. 2009; pp. 1-4; Detroit Lakes, MN USA.
SJE-Rhombus; "SubCon Variable Frequency Drive;" Dec. 2008; pp. 1-2; Detroit Lakes, MN USA.
Grundfos; "Uncomplicated Electronics . . . Advanced Design;" pp. 1-10; Undated.
Grundfos; "CU301 Installation & Operation Manual;" Apr. 2009; pp. 1-2; Undated; www.grundfos.com.
Grundfos; "CU301 Installation & Operating Instructions;" Sep. 2005; pp. 1-30; Olathe, KS USA.
ITT Corporation; "Goulds Pumps Balanced Flow Submersible Pump Controller;" Jul. 2007; pp. 1-12.
ITT Corporation; "Goulds Pumps Balanced Flow;" Jul. 2006; pp. 1-8.
ITT Corporation; "Goulds Pumps Balanced Flow Constant Pressure Controller for 2 HP Submersible Pumps;" Jun. 2005; pp. 1-4 USA.
ITT Corporation; "Goulds Pumps Balanced Flow Constant Pressure Controller for 3 HP Submersible Pumps;" Jun. 2005; pp. 1-4; USA.
Franklin Electric; Constant Pressure in Just the Right Size; Aug. 2006; pp. 1-4; Bluffton, IN USA.
Franklin Electric; "Franklin Application Installation Data;" vol. 21, No. 5, Sep./Oct. 2003; pp. 1-2; www.franklin-electric.com.
Docket Report for Case No. 5:11-cv-00459-D; Nov. 2012.
7—Motion for Preliminary Injunction by Danfoss Drives AIS & Pentair Water Pool & Spa, Inc. with respect to Civil Action No. 5:11-cv-00459-D; Sep. 30, 2011, 7 pages.
23—Declaration of E. Randolph Collins, Jr. in Support of Motion for Preliminary Injunction with respect to Civil Action 5:11-cv-00459-D; Sep. 30, 2011, 36 page.
32—Answer to Complaint with Jury Demand & Counterclaim Against Plaintiffs by Hayward Pool Products & Hayward Industries for Civil Action 5:11-cv-004590; Oct. 12, 2011, 18 pages.

(56) References Cited

OTHER PUBLICATIONS

USPTO Patent Trial and Appeal Board, Paper 47—Final Written Decision, Case IPR2013-00285, U.S. Pat. No. 8,019,479 B2, Nov. 19, 2014, 39 pages.
Pentair Pool Products, WhisperFlo Pump Owner's Manual, Jun. 5, 2001, 10 pages.

* cited by examiner

CONTROL ALGORITHM OF VARIABLE SPEED PUMPING SYSTEM

RELATED APPLICATIONS

This application is continuation of U.S. application Ser. No. 13/230,678, filed Sep. 12, 2011, which is a continuation of U.S. patent application Ser. No. 11/286,888, filed Nov. 23, 2005 and now U.S. Pat. No. 8,019,479, which is a continuation-in-part of U.S. patent application Ser. No. 10/926,513 filed Aug. 26, 2004 and now U.S. Pat. No. 7,874,808, the entire disclosures of which are hereby incorporated herein by reference.

FIELD OF THE INVENTION

The present invention relates generally to control of a pump, and more particularly to control of a variable speed pumping system for a pool, a spa or other aquatic application.

BACKGROUND OF THE INVENTION

Conventionally, a pump to be used in an aquatic application such as a pool or a spa is operable at a finite number of predetermined speed settings (e.g., typically high and low settings). Typically these speed settings correspond to the range of pumping demands of the pool or spa at the time of installation. Factors such as the volumetric flow rate of water to be pumped, the total head pressure required to adequately pump the volume of water, and other operational parameters determine the size of the pump and the proper speed settings for pump operation. Once the pump is installed, the speed settings typically are not readily changed to accommodate changes in the pumping demands.

Installation of the pump for an aquatic application such as a pool entails sizing the pump to meet the pumping demands of that particular pool and any associated features. Because of the large variety of shapes and dimensions of pools that are available, precise hydraulic calculations must be performed by the installer, often on-site, to ensure that the pumping system works properly after installation. The hydraulic calculations must be performed based on the specific characteristics and features of the particular pool, and may include assumptions to simplify the calculations for a pool with a unique shape or feature. These assumptions can introduce a degree of error to the calculations that could result in the installation of an unsuitably sized pump. Essentially, the installer is required to install a customized pump system for each aquatic application.

A plurality of aquatic applications at one location requires a pump to elevate the pressure of water used in each application. When one aquatic application is installed subsequent to a first aquatic application, a second pump must be installed if the initially installed pump cannot be operated at a speed to accommodate both aquatic applications. Similarly, features added to an aquatic application that use water at a rate that exceeds the pumping capacity of an existing pump will need an additional pump to satisfy the demand for water. As an alternative, the initially installed pump can be replaced with a new pump that can accommodate the combined demands of the aquatic applications and features.

During use, it is possible that a conventional pump is manually adjusted to operate at one of the finite speed settings. Resistance to the flow of water at an intake of the pump causes a decrease in the volumetric pumping rate if the pump speed is not increased to overcome this resistance.

Further, adjusting the pump to one of the settings may cause the pump to operate at a rate that exceeds a needed rate, while adjusting the pump to another setting may cause the pump to operate at a rate that provides an insufficient amount of flow and/or pressure. In such a case, the pump will either operate inefficiently or operate at a level below that which is desired.

Accordingly, it would be beneficial to provide a pump that could be readily and easily adapted to provide a suitably supply of water at a desired pressure to aquatic applications having a variety of sizes and features. The pump should be customizable on-site to meet the needs of the particular aquatic application and associated features, capable of pumping water to a plurality of aquatic applications and features, and should be variably adjustable over a range of operating speeds to pump the water as needed when conditions change. Further, the pump should be responsive to a change of conditions and/or user input instructions.

SUMMARY OF THE INVENTION

In accordance with one aspect, the present invention provides a pumping system for moving water of an aquatic application. The pumping system includes a water pump for moving water in connection with performance of an operation upon the water and a variable speed motor operatively connected to drive the pump. The system includes means for determining a value indicative of flow rate of water moved by the pump, and means for controlling the motor to adjust the flow rate indicative value toward a constant. The system includes means for determining a value indicative of flow pressure of water moved by the pump, and means for controlling the motor to adjust the flow pressure indicative value toward a constant. The system includes means for selecting between flow rate control and flow pressure control.

In accordance with another aspect, the present invention provides a pumping system for moving water of an aquatic application. The pumping system includes a water pump for moving water, and a variable speed motor operatively connected to drive the pump. The system includes means for controlling the motor to adjust motor output, means for performing a first operation upon the moving water, and means for performing a second operation upon the moving water. The system includes means for using control parameters for the motor during the first operation based upon a target water volume, and means for determining volume of water moved by the pump during a time period. The system also includes means for changing the control parameters used for the first operation dependent upon performance of the second operation during the time period.

In accordance with another aspect, the present invention provides a pumping system for moving water of an aquatic application. The pumping system includes a water pump for moving water in connection with performance of an operation upon the water and a variable speed motor operatively connected to drive the pump. The system includes means for determining flow rate of water moved by the pump, and means for controlling the motor to adjust the flow rate toward a constant flow rate value. The system includes means for determining flow pressure of water moved by the pump, and means for controlling the motor to adjust the flow pressure toward a constant flow pressure value. The system includes means for selecting between flow rate control and flow pressure control.

In accordance with yet another aspect, the present invention provides a pumping system for moving water of an aquatic application. The pumping system includes a water pump for moving water, and means for controlling operation of the pump to perform a first water operation with at least one predetermined parameter. The system includes means for operating the pump to perform a second water operation, and means for altering control of operation of the pump to perform the first water operation to vary the at least one parameter in response to operation of the pump to perform the second operation.

In accordance with yet another aspect, the present invention provides a pumping system for moving water of an aquatic application. The pumping system includes a water pump for moving water, and means for controlling a routine filter cycle. The system includes means for operating the pump to perform an additional water operation, and means for altering the routine filter cycle in response to operation of the pump to perform the additional water operation.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF EXAMPLE EMBODIMENTS

Figure 1:
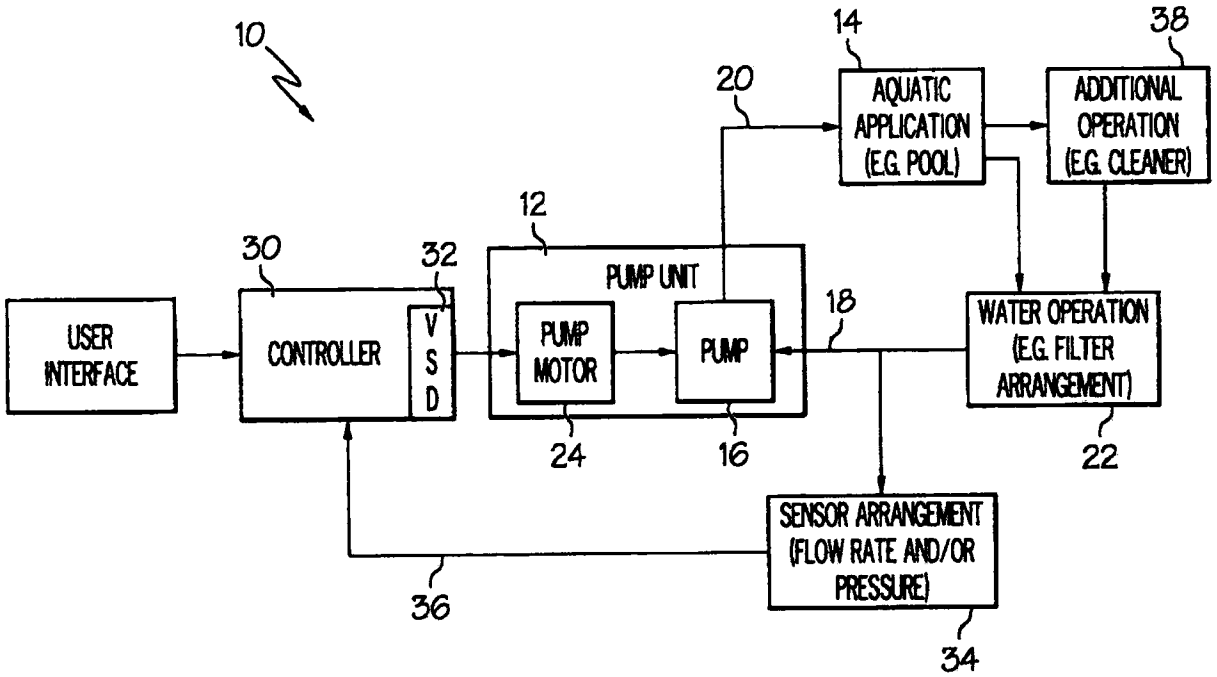
FIG. 1 is a block diagram of an example of a variable speed pumping system in accordance with the present invention with a pool environment.

Certain terminology is used herein for convenience only and is not to be taken as a limitation on the present invention. Further, in the drawings, the same reference numerals are employed for designating the same elements throughout the figures, and in order to clearly and concisely illustrate the present invention, certain features may be shown in somewhat schematic form.

An example variable-speed pumping system 10 in accordance with one aspect of the present invention is schematically shown in FIG. 1. The pumping system 10 includes a pump unit 12 that is shown as being used with a pool 14. It is to be appreciated that the pump unit 12 includes a pump 16 for moving water through inlet and outlet lines 18 and 20.

The pool 14 is one example of an aquatic application with which the present invention may be utilized. The phrase "aquatic application" is used generally herein to refer to any reservoir, tank, container or structure, natural or man-made, having a fluid, capable of holding a fluid, to which a fluid is delivered, or from which a fluid is withdrawn. Further, "aquatic application" encompasses any feature associated with the operation, use or maintenance of the aforementioned reservoir, tank, container or structure. This definition of "aquatic application" includes, but is not limited to pools, spas, whirlpool baths, landscaping ponds, water jets, waterfalls, fountains, pool filtration equipment, pool vacuums, spillways and the like. Although each of the examples provided above includes water, additional applications that include liquids other than water are also within the scope of the present invention. Herein, the terms pool and water are used with the understanding that they are not limitations on the present invention.

A water operation 22 is performed upon the water moved by the pump 16. Within the shown example, water operation 22 is a filter arrangement that is associated with the pumping system 10 and the pool 14 for providing a cleaning operation (i.e., filtering) on the water within the pool. The filter arrangement 22 is operatively connected between the pool 14 and the pump 16 at/along an inlet line 18 for the pump. Thus, the pump 16, the pool 14, the filter arrangement 22, and the interconnecting lines 18 and 20 form a fluid circuit or pathway for the movement of water.

It is to be appreciated that the function of filtering is but one example of an operation that can be performed upon the water. Other operations that can be performed upon the water may be simplistic, complex or diverse. For example, the operation performed on the water may merely be just movement of the water by the pumping system (e.g., recirculation of the water in a waterfall or spa environment).

Turning to the filter arrangement 22, any suitable construction and configuration of the filter arrangement is possible. For example, the filter arrangement 22 may include a skimmer assembly for collecting coarse debris from water being withdrawn from the pool, and one or more filter components for straining finer material from the water.

The pump 16 may have any suitable construction and/or configuration for providing the desired force to the water and move the water. In one example, the pump 16 is a common centrifugal pump of the type known to have impellers extending radially from a central axis. Vanes defined by the impellers create interior passages through which the water passes as the impellers are rotated. Rotating the impellers about the central axis imparts a centrifugal force on water therein, and thus imparts the force flow to the water. Although centrifugal pumps are well suited to pump a large volume of water at a continuous rate, other motor-operated pumps may also be used within the scope of the present invention.

Drive force is provided to the pump 16 via a pump motor 24. In the one example, the drive force is in the form of rotational force provided to rotate the impeller of the pump 16. In one specific embodiment, the pump motor 24 is a permanent magnet motor. In another specific embodiment, the pump motor 24 is a three-phase motor. The pump motor 24 operation is infinitely variable within a range of operation (i.e., zero to maximum operation). In one specific example, the operation is indicated by the RPM of the rotational force provided to rotate the impeller of the pump 16.

A controller 30 provides for the control of the pump motor 24 and thus the control of the pump 16. Within the shown example, the controller 30 includes a variable speed drive 32 that provides for the infinitely variable control of the pump motor 24 (i.e., varies the speed of the pump motor). By way of example, within the operation of the variable speed drive 32, a single phase AC current from a source power supply is converted (e.g., broken) into a three-phase DC current. Any suitable technique and associated construction/configuration may be used to provide the three-phase DC current.

For example, the construction may include capacitors to correct line supply over or under voltages. The variable speed drive supplies the DC electric power at a changeable frequency to the pump motor to drive the pump motor. The construction and/or configuration of the pump 16, the pump motor 24, the controller 30 as a whole, and the variable speed drive 32 as a portion of the controller 30, are not limitations on the present invention. In one possibility, the pump 16 and the pump motor 24 are disposed within a single housing to form a single unit, and the controller 30 with the variable speed drive 32 are disposed within another single housing to form another single unit. In another possibility, these components are disposed within a single housing to form a single unit.

The pumping system 10 has means used for control of the operation of the pump. In accordance with one aspect of the present invention, the pumping system 10 includes means for sensing, determining, or the like one or more parameters indicative of the operation performed upon the water. Within one specific example, the system includes means for sensing, determining or the like one or more parameters indicative of the movement of water within the fluid circuit.

The ability to sense, determine or the like one or more parameters may take a variety of forms. For example, one or more sensors 34 may be utilized. Such one or more sensors 34 can be referred to as a sensor arrangement. The sensor arrangement 34 of the pumping system 10 would sense one or more parameters indicative of the operation performed upon the water. Within one specific example, the sensor arrangement 34 senses parameters indicative of the movement of water within the fluid circuit. The movement along the fluid circuit includes movement of water through the filter arrangement 22. As such, the sensor arrangement 34 includes at least one sensor used to determine flow rate of the water moving within the fluid circuit and/or includes at least one sensor used to determine flow pressure of the water moving within the fluid circuit. In one example, the sensor arrangement 34 is operatively connected with the water circuit at/adjacent to the location of the filter arrangement 22. It should be appreciated that the sensors of the sensor arrangement 34 may be at different locations than the locations presented for the example. Also, the sensors of the sensor arrangement 34 may be at different locations from each other. Still further, the sensors may be configured such that different sensor portions are at different locations within the fluid circuit. Such a sensor arrangement 34 would be operatively connected 36 to the controller 30 to provide the sensory information thereto.

It is to be noted that the sensor arrangement 34 may accomplish the sensing task via various methodologies, and/or different and/or additional sensors may be provided within the system 10 and information provided therefrom may be utilized within the system. For example, the sensor arrangement 34 may be provided that is associated with the filter arrangement and that senses an operation characteristic associated with the filter arrangement. For example, such a sensor may monitor filter performance. Such monitoring may be as basic as monitoring filter flow rate, filter pressure, or some other parameter that indicates performance of the filter arrangement. Of course, it is to be appreciated that the sensed parameter of operation may be otherwise associated with the operation performed upon the water. As such, the sensed parameter of operation can be as simplistic as a flow indicative parameter such as rate, pressure, etc.

Such indication information can be used by the controller 30, via performance of a program, algorithm or the like, to perform various functions, and examples of such are set forth below. Also, it is to be appreciated that additional functions and features may be separate or combined, and that sensor information may be obtained by one or more sensors.

With regard to the specific example of monitoring flow rate and flow pressure, the information from the sensor arrangement 34 can be used as an indication of impediment or hindrance via obstruction or condition, whether physical, chemical, or mechanical in nature, that interferes with the flow of water from the aquatic application to the pump such as debris accumulation or the lack of accumulation, within the filter arrangement 34. As such, the monitored information is indicative of the condition of the filter arrangement.

Within another example (FIG. 2) of a pumping system 110 that includes means for sensing, determining, or the like one or more parameters indicative of the operation performed upon the water, the controller 130 can determine the one or more parameters via sensing, determining or the like parameters associated with the operation of a pump 116 of a pump unit 112. Such an approach is based upon an understanding that the pump operation itself has one or more relationships to the operation performed upon the water.

It should be appreciated that the pump unit 112, which includes the pump 116 and a pump motor 124, a pool 114, a filter arrangement 122, and interconnecting lines 118 and 120, may be identical or different from the corresponding items within the example of FIG. 1.

Figure 2:
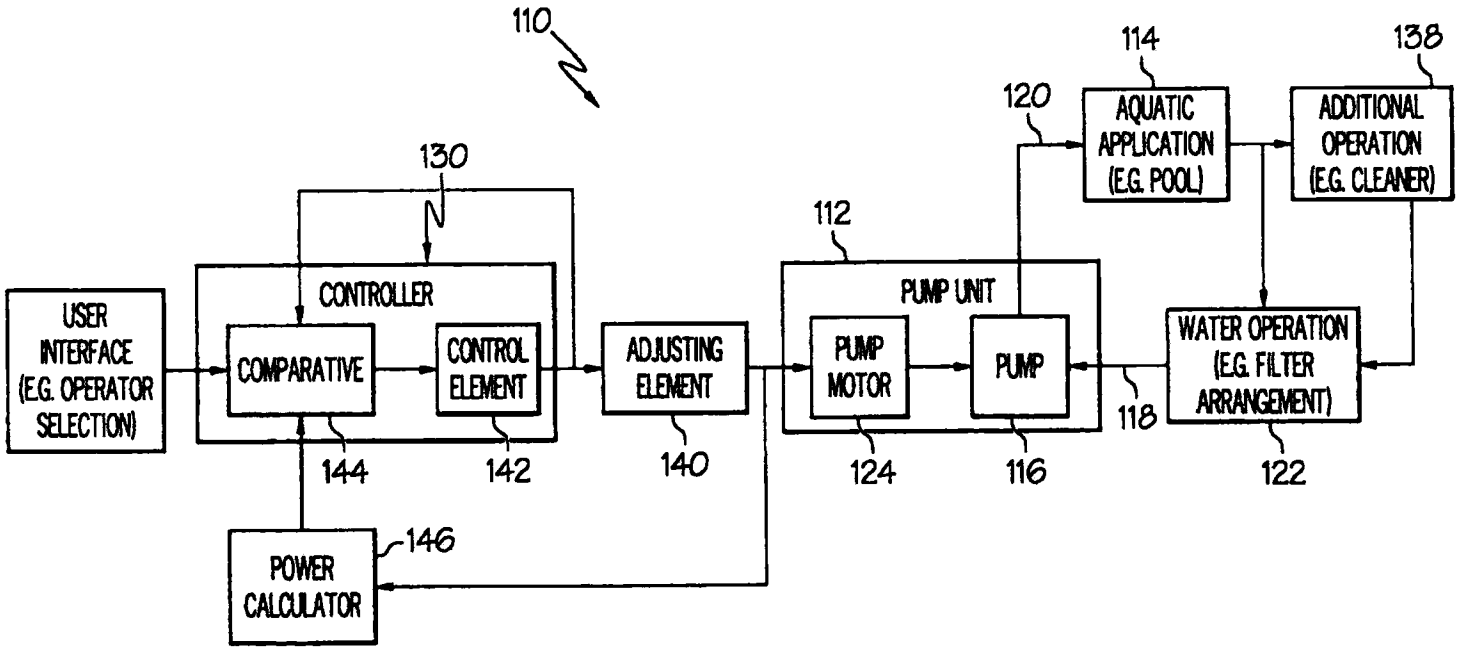
FIG. 2 is another block diagram of another example of a variable speed pumping system in accordance with the present invention with a pool environment.

Turning back to the example of FIG. 2, some examples of the pumping system 110, and specifically the controller 130 and associated portions, that utilize at least one relationship between the pump operation and the operation performed upon the water attention are shown in U.S. Pat. No. 6,354,805, to Moller, entitled "Method For Regulating A Delivery Variable Of A Pump" and U.S. Pat. No. 6,468,042, to Moller, entitled "Method For Regulating A Delivery Variable Of A Pump." The disclosures of these patents are incorporated herein by reference. In short summary, direct sensing of the pressure and/or flow rate of the water is not performed, but instead one or more sensed or determined parameters associated with pump operation are utilized as an indication of pump performance. One example of such a pump parameter is input power. Pressure and/or flow rate can be calculated/determined from such pump parameter(s).

Although the system 110 and the controller 130 there may be of varied construction, configuration and operation, the function block diagram of FIG. 2 is generally representative. Within the shown example, an adjusting element 140 is operatively connected to the pump motor and is also operatively connected to a control element 142 within the controller 130. The control element 142 operates in response to a comparative function 144, which receives input from a power calculation 146.

The power calculation 146 is performed utilizing information from the operation of the pump motor 124 and controlled by the adjusting element 140. As such, a feedback iteration is performed to control the pump motor 124. Also, it is the operation of the pump motor and the pump that provides the information used to control the pump motor/pump. As mentioned, it is an understanding that operation of the pump motor/pump has a relationship to the flow rate and/or pressure of the water flow that is utilized to control flow rate and/or flow pressure via control of the pump.

As mentioned, the sensed, determined (e.g., calculated, provided via a look-up table, etc.), etc. information is utilized to determine the flow rate and/or the flow pressure. In one example, the operation is based upon an approach in which the pump (e.g., 16 or 116) is controlled to operate at a lowest amount that will accomplish the desired task (e.g., maintain a desired filtering level of operation) via a constant flow rate. Specifically, as the sensed parameter changes, the lowest level of pump operation (i.e., pump speed) to accomplish the desired task will need to change. The controller (e.g., 30 or 130) provides the control to operate the pump motor/pump accordingly. In other words, the controller (e.g., 30 or 130) repeatedly adjusts the speed of the pump motor (e.g., 24 or 124) to a minimum level responsive to the sensed/determined parameter to maintain operation at a specific level. Such an operation mode can provide for minimal energy usage.

Turning to the issue of operation of the system (e.g., 10 or 110) over a course of a long period of time, it is typical that a predetermined volume of water flow is desired. For example, it may be desirable to move a volume of water equal to the volume within the aquatic application (e.g., pool or spa). Such movement of water is typically referred to as a turnover. It may be desirable to move a volume of water equal to multiple turnovers within a specified time period (e.g., a day). Within an example in which the water operation includes a filter operation, the desired water movement (e.g., specific number of turnovers within one day) may be related to the necessity to maintain a desired water clarity.

Within the water operation that contains a filter operation, the amount of water that can be moved and/or the ease by which the water can be moved is dependent in part upon the current state (e.g., quality) of the filter arrangement. In general, a dean (e.g., new, fresh) filter arrangement provides a lesser impediment to water flow than a filter arrangement that has accumulated filter matter (e.g., dirty). For a constant flow rate through a filter arrangement, a lesser pressure is required to move the water through a clean filter arrangement than a pressure that is required to move the water through a dirty filter arrangement. Another way of considering the effect of dirt accumulation is that if pressure is kept constant then the flow rate will decrease as the dirt accumulates and hinders (e.g., progressively blocks) the flow.

Turning to one aspect that is provided by the present invention, the system can operate to maintain a constant flow of water within the circuit. Maintenance of constant flow is useful in the example that includes a filter arrangement. Moreover, the ability to maintain a constant flow is useful when it is desirable to achieve a specific flow volume during a specific period of time. For example, it may be desirable to filter pool water and achieve a specific number of water turnovers within each day of operation to maintain a desired water clarity despite the fact that the filter arrangement will progressively increase dirt accumulation.

It should be appreciated that maintenance of a constant flow volume despite an increasing impediment caused by filter dirt accumulation requires an increasing pressure and is the result of increasing motive force from the pump/motor. As such, one aspect of the present invention is to control the motor/pump to provide the increased motive force that provides the increased pressure to maintain the constant flow.

Of course, continuous pressure increase to address the increase in filter dirt impediment is not useful beyond some level. As such, in accordance with another aspect of the present invention, the system (e.g., 10 or 110) controls operation of the motor/pump such that the motive force is not increased and the flow rate is thus not maintained constant. In one example, the cessation of increases in motive force occurs once a specific pressure level (e.g., a threshold) is reached. A pressure level threshold may be related to a specific filter type, system configuration, etc. In one specific example, the specific pressure level threshold is predetermined. Also, within one specific example, the specific pressure level threshold may be a user or technician-entered parameter.

Within another aspect of the present invention, the system (e.g., 10 or 110) may operate to reduce pressure while the pressure is above the pressure level threshold. Within yet another, related aspect of the present invention, the system (e.g., 10 or 110) may return to control of the flow rate to maintain a specific, constant flow rate subsequent to the pressure being reduced below the pressure level threshold.

Within yet another aspect of the present invention, the system (e.g., 10 or 110) may operate to have different constant flow rates during different time periods. Such different time periods may be sub-periods (e.g., specific hours) within an overall time period (e.g., a day) within which a specific number of water turnovers is desired. During some time periods a larger flow rate may be desired, and a lower flow rate may be desired at other time periods. Within the example of a swimming pool with a filter arrangement as part of the water operation, it may be desired to have a larger flow rate during pool-use time (e.g., daylight hours) to provide for increased water turnover and thus increased filtering of the water. Within the same swimming pool example, it may be desired to have a lower flow rate during non-use (e.g., nighttime hours).

Figure 3:
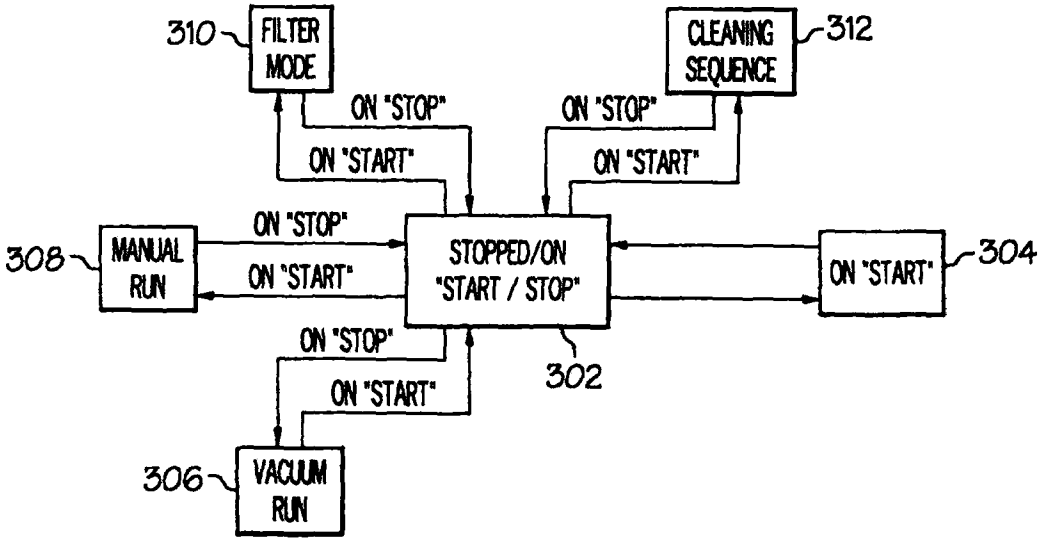
FIG. 3 is a function flow chart for an example methodology in accordance with the present invention.

Turning to one specific example, attention is directed to the top-level operation chart that is shown in FIG. 3. With the chart, it can be appreciated that the system has an overall ON/OFF status 302 as indicated by the central box. Specifically, overall operation is started 304 and thus the system is ON. However, under the penumbra of a general ON state, a number of modes of operation can be entered. Within the shown example, the modes are Vacuum run 306, Manual run 308, Filter 310, and Cleaning sequence 312.

Briefly, the Vacuum run mode 306 is entered and utilized when a vacuum device is utilized within the pool (e.g., 14 or 114). For example, such a vacuum device is typically connected to the pump (e.g., 16 or 116), possibly through the filter arrangement, (e.g., 22 or 122) via a relative long extent of hose and is moved about the pool (e.g., 14 or 114) to clean the water at various locations and/or the surfaces of the pool at various locations. The vacuum device may be a manually moved device or may autonomously move.

Similarly, the manual run mode 308 is entered and utilized when it is desired to operate the pump outside of the other specified modes. The cleaning sequence mode 312 is for operation performed in the course of a cleaning routine.

Turning to the filter mode 310, this mode is a typical operation mode in order to maintain water clarity within the pool (e.g., 14 or 114). Moreover, the filter mode 310 is operated to obtain effective filtering of the pool while minimizing energy consumption. As one example of the filter mode 310, attention is directed to the flow chart of FIG. 4 that shows an example process 400 for accomplishing a filter function within the filter mode. Specifically, the pump is operated to move water through the filter arrangement. It is noted that the example process is associated with the example of FIG. 2. However, it is to be appreciated that a similar process occurs associated with the example of FIG. 1.

The process 400 (FIG. 4) is initiated at step 402 and proceeds to step 404. At step 404 information is retrieved from a filter menu. The information may take a variety of forms and may have a variety of contents. As one example, the information includes cycles of circulation of the water per day, turnovers per day, scheduled time (e.g., start and stop times for a plurality of cycles), pool size, filter pressure before achieving a service systems soon status, and maximum priming time. It should be appreciated that such information (e.g., values) is desired and/or intended, and/or preselected/predetermined.

Subsequent to step 404, the process 400 proceeds to step 406 in which one or more calculations are performed. For example, a filter flow value is determined based upon a ratio of pool size to scheduled time (e.g., filter flow equals pool size divided by scheduled time). Also, the new off time may be calculated for the scheduled time (e.g., a cut off time). Next, the process 400 proceeds to step 408 in which a "START" is activated to begin repetitive operation of the filter mode.

The process 400 proceeds from step 408 to step 410 in which it is determined whether the flow is above a priming flow value. If the determination at step 410 is negative (e.g., the flow is not above a priming flow value), the process 400 proceeds to step 412. Within step 412, the flow control process is performed. As mentioned above, the flow control process may be similar to the process disclosed within U.S. Pat. No. 6,354,805 or U.S. Pat. No. 6,468,042. It should be noted that step 414 provides input that is utilized within step 412. Specifically, hardware input such as power and speed measurement are provided. This information is provided via a hardware input that can give information in a form of current and/or voltage as an indication of power and speed measurement of the pump motor. Associated with step 414 is step 416 in which shaft power provided by the pump motor is calculated. At step 418, a priming dry alarm step is provided. In one example, if the shaft power is zero for ten seconds, a priming dry alarm is displayed and the process 400 is interrupted and does not proceed any further until the situation is otherwise corrected.

Returning to step 412, it should be appreciated that subsequent to operation of the step 412, the process 400 returns to step 410 in which the query concerning the flow being above a priming flow is repeated. If the determination within step 410 is affirmative (i.e., the flow is above the priming flow value), the process 400 proceeds from step 410 to step 420.

It should be appreciated that steps 408 and 420 provide two bits of information that is utilized within an ancillary step 421. Specifically, step 408 provides a time start indication and step 420 provides a time primed indication. Within step 421, a determination concerning a priming alarm is made. Specifically, if priming control (i.e., the system is determined to be primed), is not reached prior to a maximum priming time allotment, a priming alarm is displayed, and the process 400 is interrupted and does not proceed any further until the situation is addressed and corrected.

Returning to step 420, the process 400 proceeds from step 420 to step 422 in which a flow reference is set equal to the current filter flow value. Subsequent to step 422, the process 400 proceeds to step 424. At step 424, it is determined whether the system is operating at a specified flow reference. The filter flow is defined in terms of volume based upon time. If the determination at step 424 is negative (i.e., the system is not operating at the flow reference level), the process 400 proceeds to step 426. At step 426, the flow control process is performed, similar to step 412. As such, step 414 also provides input that is utilized within step 426. Subsequent to step 426, the process returns to step 424.

If the determination with step 424 is affirmative (i.e., the system is operating at the flow reference level), the process 400 proceeds to step 428 in which pressure is calculated. Pressure can be calculated based upon information derived from operation of the pump. Subsequent to step 428, the process 400 proceeds to step 430. At 430, a determination is made as to whether the pressure is above a maximum filter pressure.

It should be noted that step 432 of the process 400 provides input to the determination within the step 430. Specifically, at step 432 a menu of data that contains a maximum filter pressure value is accessed. If the determination at step 430, is negative (i.e., the pressure is not above the maximum filter pressure), the process 400 proceeds to step 434. At step 434, the filter status is updated in the menu memory. Subsequent to step 434, the process 400 proceeds to step 436.

At step 436, a determination is made as to whether the flow reference is equal to the filter flow. If the determination as step 436 is affirmative (i.e., the flow reference is equal to the filter flow), the process 400 loops back to step 422.

However, if the determination at step 436 is negative (i.e., the flow reference is not equal to the filter flow), the process 400 proceeds to steps 438 and 440.

Within step 438, a determination is made as to whether the filter status is higher than 100%. If so, a service system soon indication is displayed. At step 440, a flow reference at reference N is readjusted to equal a previous flow reference (i.e., N−1 plus a specific value). Within the shown example, the additional value is 1 gallon per minute. Subsequent to the adjustment of the flow reference, the process 400 proceeds to step 428 for repeat of step 428 and at least some of the subsequent process steps.

Focusing again upon step 430, if the determination at step 430 is affirmative (i.e., the pressure is above the maximum filter pressure), the process 400 proceeds from step 430 to step 442. At step 442, the process 400 changes from flow control to pressure control. Specifically, it is to be appreciated that up to this time, the process 400 has attempted to maintain the flow rate at an effectively constant value. However, from step 442, the process 400 will attempt to maintain the flow pressure at effectively a constant value.

The process 400 proceeds from step 442 to step 444. Within step 444, a flow reference value is adjusted. Specifically, the flow reference value for time index N is set equal to the flow reference value for time index N−1 that has been decreased by a predetermined value. Within this specific example, the decreased value is 1 gallon per minute. Subsequent to step 444, the process 400 proceeds to step 446 in which the flow controller, as previously described, performs its function. Similar to the steps 412 and 426, step 446 obtains hardware input. For example, power and speed measuring information is provided for use within the flow controller. Subsequent to step 446, the process 400 proceeds to step 448.

Within the step 448 a determination is made as to whether the flow equals a flow reference. If the determination within step 448 is negative (i.e., the flow does not equal the flow reference), the process 400 proceeds from step 448 back to step 446. However, if the determination within step 448 is affirmative (i.e., the flow is equal to the flow reference), the process 400 proceeds from step 448 to step 450. Within step 450, the status of filter arrangement is updated within the memory of the menu. Subsequent to step 450, the process 400 proceeds back to step 428 and at least some of the subsequent steps are repeated.

Figure 4A:
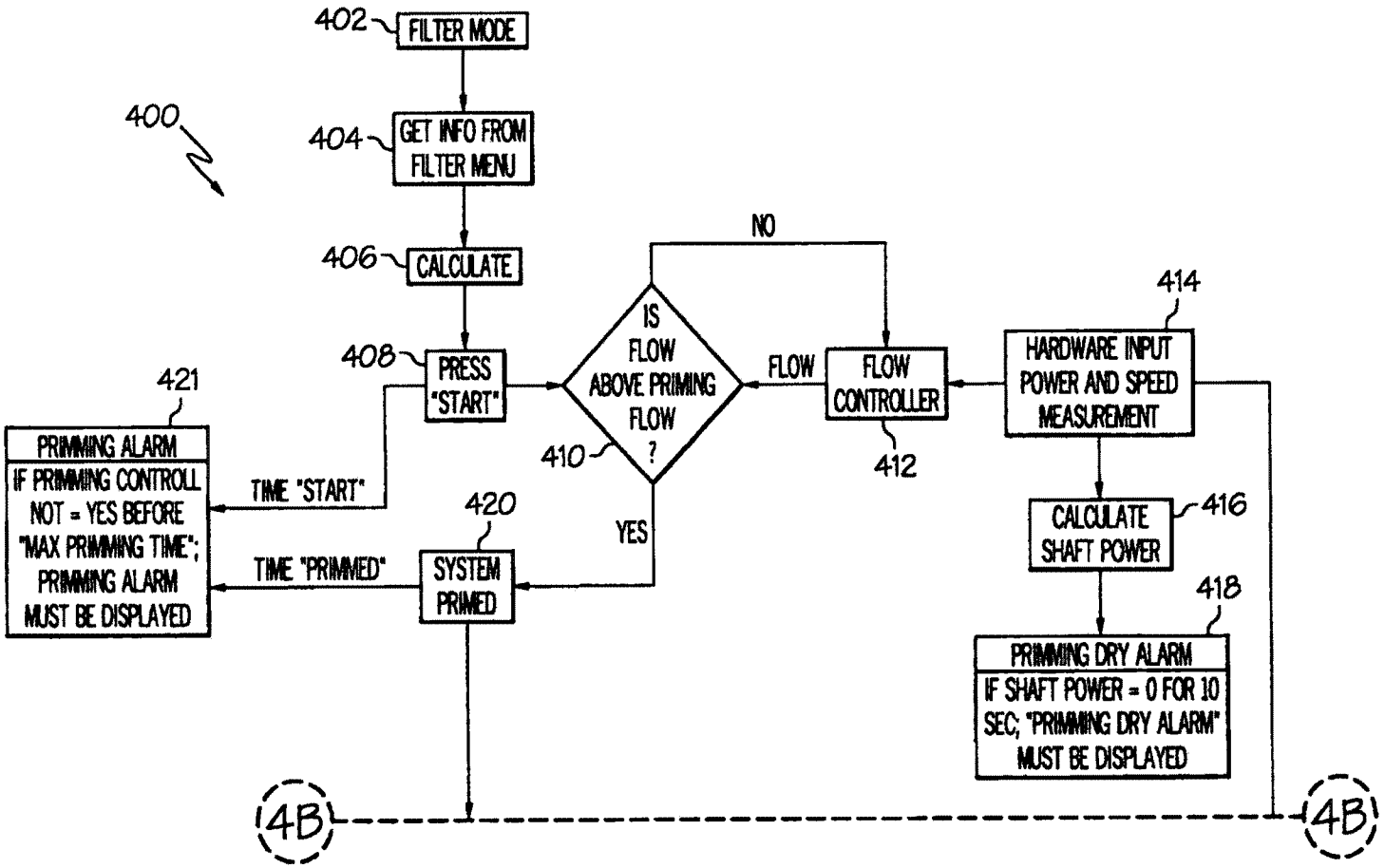
FIGS. 4A and 4B are a flow chart for an example of a process in accordance with an aspect of the present invention.
Figure 4B:
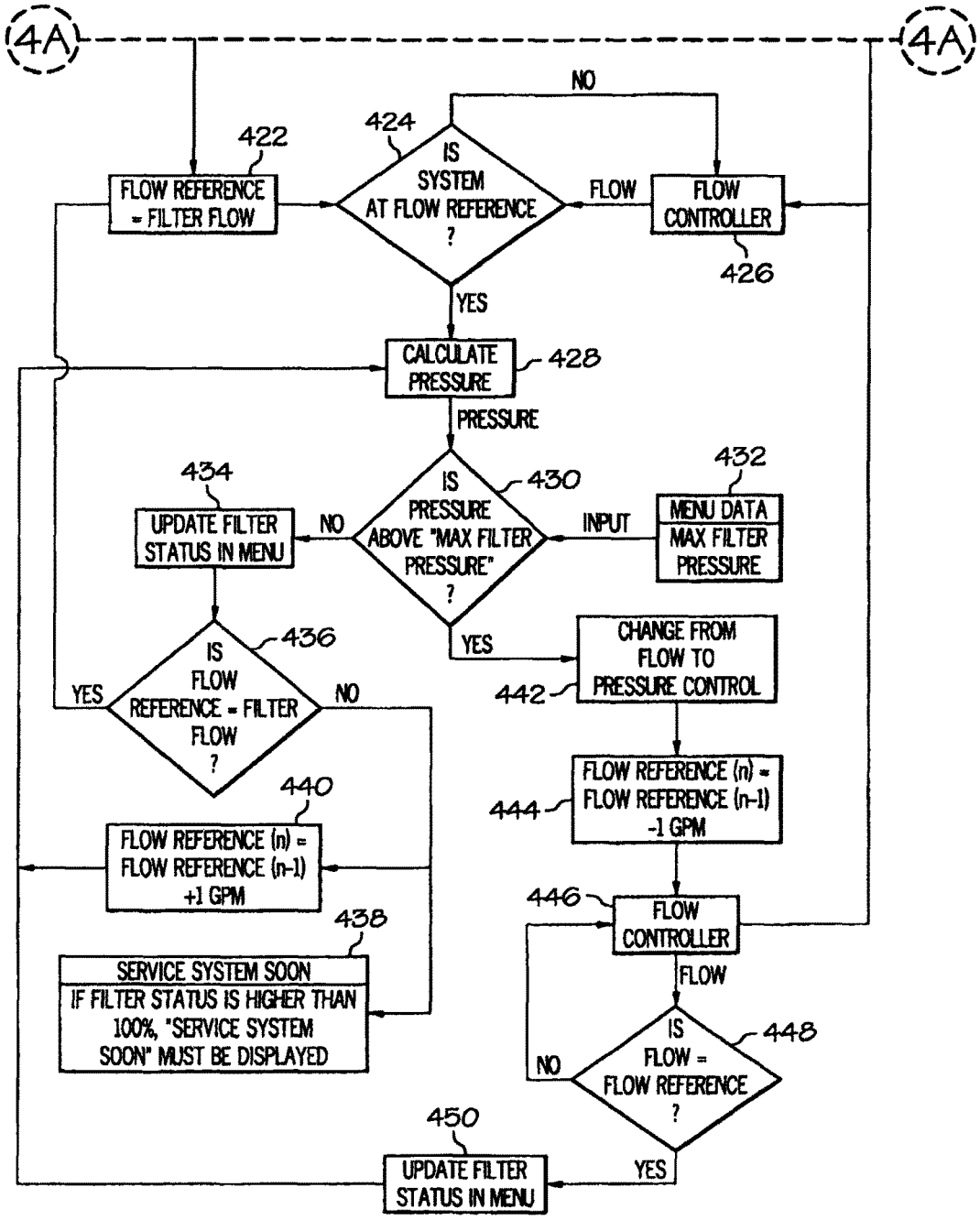

One of the advantages provided by the example shown within FIG. 4 is that a minimum amount of energy is extended to maintain a constant flow so long as the filter arrangement does not provide an excessive impediment to flow of water. However, subsequent to the filter arrangement becoming a problem to constant flow (e.g., the filter arrangement is sufficiently clogged), the methodology provides for a constant pressure to be maintained to provide for at least some filtering function despite an associated decrease in flow. Moreover, the process is iterative to constantly adjust the flow or the pressure to maintain a high efficiency coupled with a minimal energy usage.

In accordance with another aspect, it should be appreciated that the filtering function, as a free standing operation, is intended to maintain clarity of the pool water. However, it should be appreciated that the pump (e.g., 16 or 116) may also be utilized to operate other functions and devices such as a separate cleaner, a water slide, or the like. The example of FIG. 1 shows an example additional operation 38 and the example of FIG. 2 shows an example additional operation 138. Such an additional operation (e.g., 38 or 138) may be a cleaner device, either manual or autonomous. As can be appreciated, an additional operation involves additional water movement. Also, within the presented examples of FIGS. 1 and 2, the water movement is through the filter arrangement (e.g., 22 or 122). Such, additional water movement may be used to supplant the need for other water movement, in accordance with one aspect of the present invention and as described further below.

Associated with such other functions and devices is a certain amount of water movement. The present invention, in accordance with one aspect, is based upon an appreciation that such other water movement may be considered as part of the overall desired water movement, cycles, turnover, filtering, etc. As such, water movement associated with such other functions and devices can be utilized as part of the overall water movement to achieve desired values within a specified time frame. Utilizing such water movement can allow for minimization of a purely filtering aspect. This permits increased energy efficiency by avoiding unnecessary pump operation.

Figure 5A:
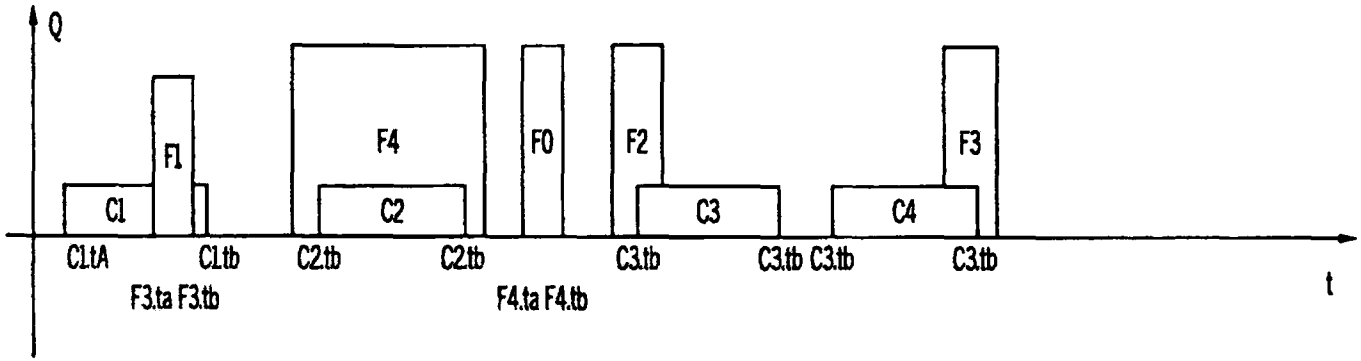
FIGS. 5A-5C are time lines showing operations that may be performed via a system in accordance with the present.

FIG. 5A is an example time line that shows a typical operation that includes both filter cycles (C1-C4) and several various other operations and/or devices (F0-F4) that are operated. It should be appreciated that pump operation for all of these cycles, functions, and devices would be somewhat wasteful. As such, the present invention provides a means to reduce a routine filtration cycle (e.g., C1-C4) in response to occurrence of one or more operations (e.g., F0-F4). Below are a series of equations that check for overlap and cutoff based upon utilization of all of the features (routine filtration cycles, C1-C4, and all other operations, F0-F4).

```
Overlap check and "cutoff" calculations for features for: all F's and C's
case F0 type: (Fx.start < Cx.start & Fx.stop < Cx.start) || (Fx.start >
Cx.stop & Fx.stop > Cx.stop)
    cutOff + = 0
case F1 type: Fx.start > Cx.start & Fx.stop < Cx.stop
    cutOff + = Fx.stop − Fx.start
case F2 type: Fx.start < Cx.start & Fx.stop < Cx.stop & Fx.stop > Cx.start
    cutOff + = Fx.stop − Cx.start
case F3 type: Fx.start > Cx.start & Fx.start < Cx.stop & Fx.stop > Cx.stop
    cutOff + = Cx.stop − Fx.start
case F4 type: Fx.start < Cx.start & Fx.stop > Cx.stop
    cutOff + = Cx.stop − Cx.start
```

Figure 5B:
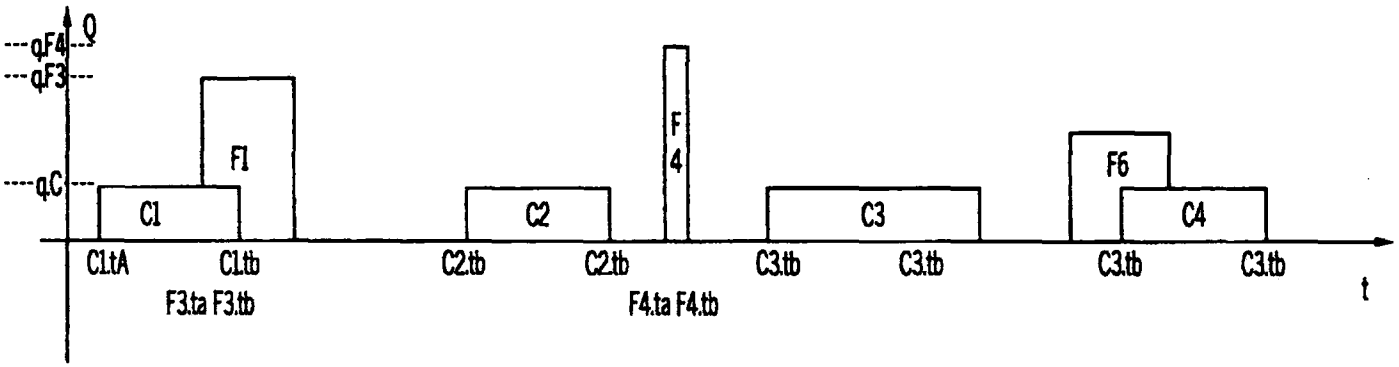
Figure 5C:
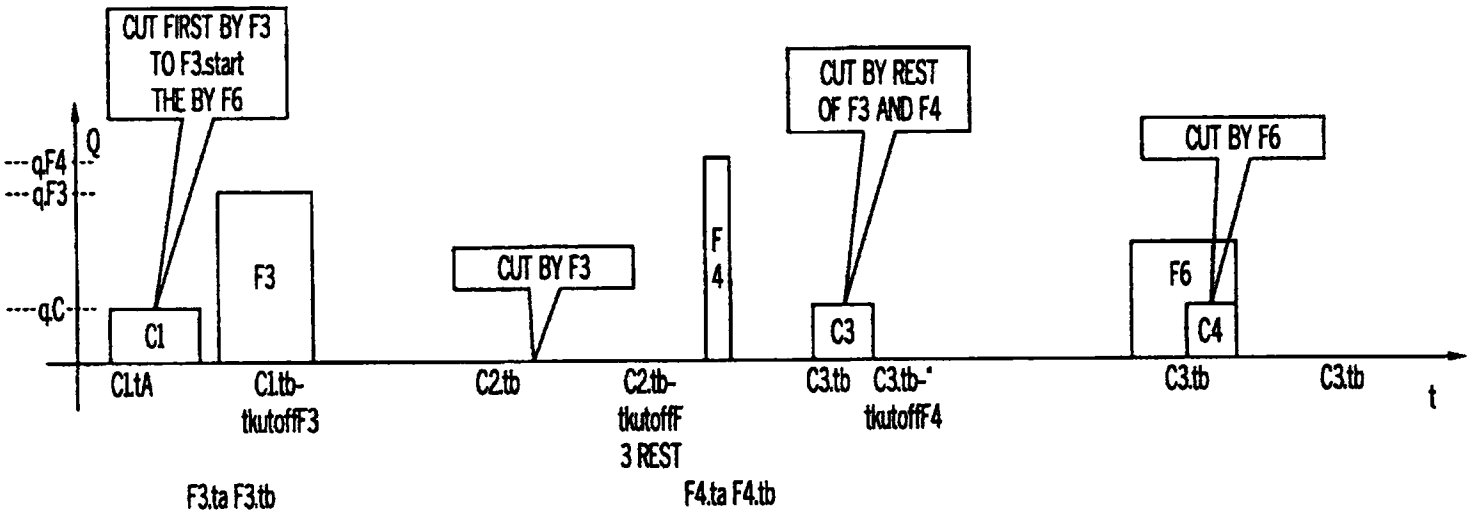

An example of how the routine filtration cycles are reduced is shown via a comparison of FIGS. 5B and 5C. Specifically, FIG. 5B shows the cycles for routine filtration (C1-C2) and three other pump operation routines (e.g., F3, F4, and F6). As to be appreciated, because the other operations (F3, F4, and F6) will provide some of the necessary water movement, the routine filtration cycles can be reduced or otherwise eliminated. The equations set forth below provide an indication of how the routine filtration cycles can be reduced or eliminated.

```
k=q × t ,konst = flow × time
For (all F's with k>0){
  krestF = k
  for (all C's)
  if FTstart > CTstart & FTstart < CTstop)
    krestF + kF − k(CTb − Fta)
  else
    if (krestF < krestC)
    krestC = krestC − krestF
    CTstop = CTstart + (kcrestC/qC)

      Cq = Ck / (CTstop − CTstart)

  else
    krestF = krestF − krestC
    delete C
```

FIG. 5C shows how the routine filtration cycles C1-C4 are reduced or eliminated. It should be appreciated that the other functions (F3, F4, and F6 remain).

Focusing on the aspect of minimal energy usage, within some know pool filtering applications, it is common to operate a known pump/filter arrangement for some portion (e.g., eight hours) of a day at effectively a very high speed to accomplish a desired level of pool cleaning. With the present invention, the system (e.g., 10 or 110) with the associated filter arrangement (e.g., 22 or 122) can be operated continuously (e.g., 24 hours a day, or some other time amount(s)) at an ever-changing minimum level to accomplish the desired level of pool cleaning. It is possible to achieve a very significant savings in energy usage with such a use of the present invention as compared to the known pump operation at the high speed. In one example, the cost savings would be in the range of 90% as compared to a known pump/filter arrangement.

Accordingly, one aspect of the present invention is that the pumping system controls operation of the pump to perform a first water operation with at least one predetermined parameter. The first operation can be routine filtering and the parameter may be timing and or water volume movement (e.g., flow rate or pressure). The pump can also be operated to perform a second water operation, which can be anything else besides just routine filtering (e.g., cleaning). However, in order to provide for energy conservation, the first operation (e.g., just filtering) is controlled in response to performance of the second operation (e.g., running a cleaner).

Aquatic applications will have a variety of different water demands depending upon the specific attributes of each aquatic application. Turning back to the aspect of the pump that is driven by the infinitely variable motor, it should be appreciated that precise sizing, adjustment, etc. for each application of the pump system for an aquatic application can thus be avoided. In many respects, the pump system is self adjusting to each application.

It is to be appreciated that the controller (e.g., 30 or 130) may have various forms to accomplish the desired functions. In one example, the controller 30 includes a computer processor that operates a program. In the alternative, the program may be considered to be an algorithm. The program may be in the form of macros. Further, the program may be changeable, and the controller 30 is thus programmable.

Figure 6:
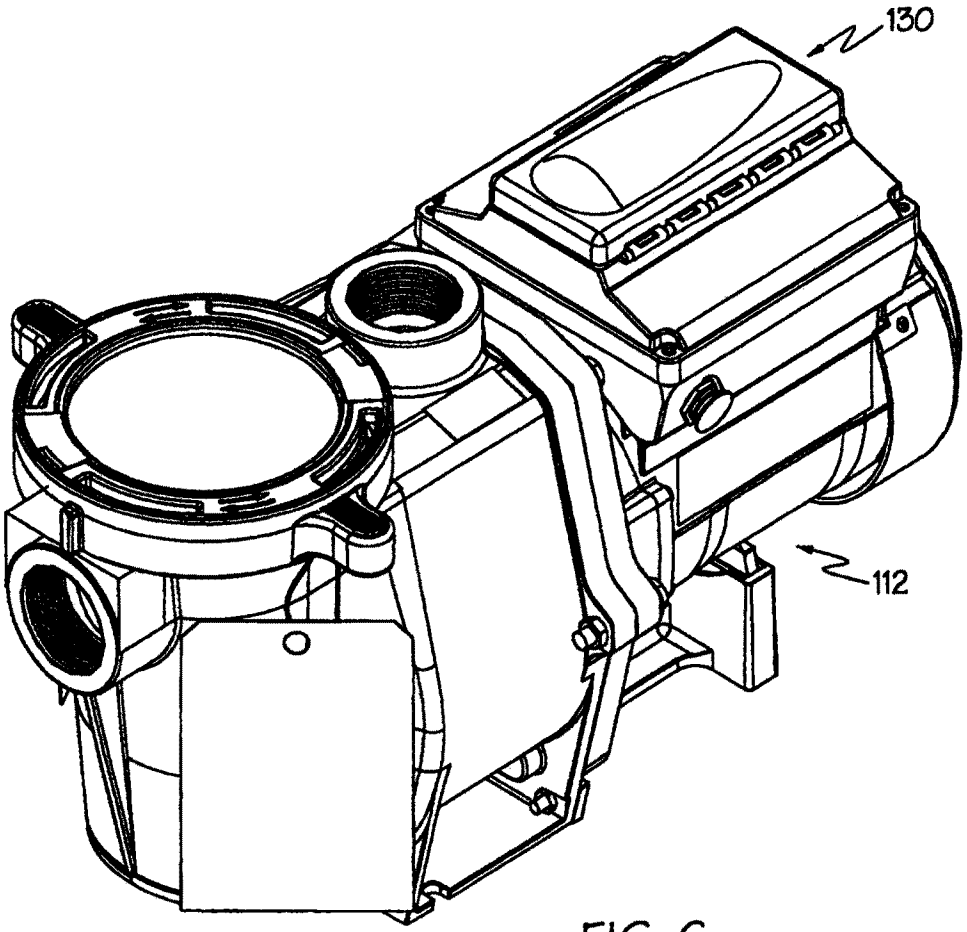
FIG. 6 is a perceptive view of an example pump unit that incorporates the present invention.
Figure 7:
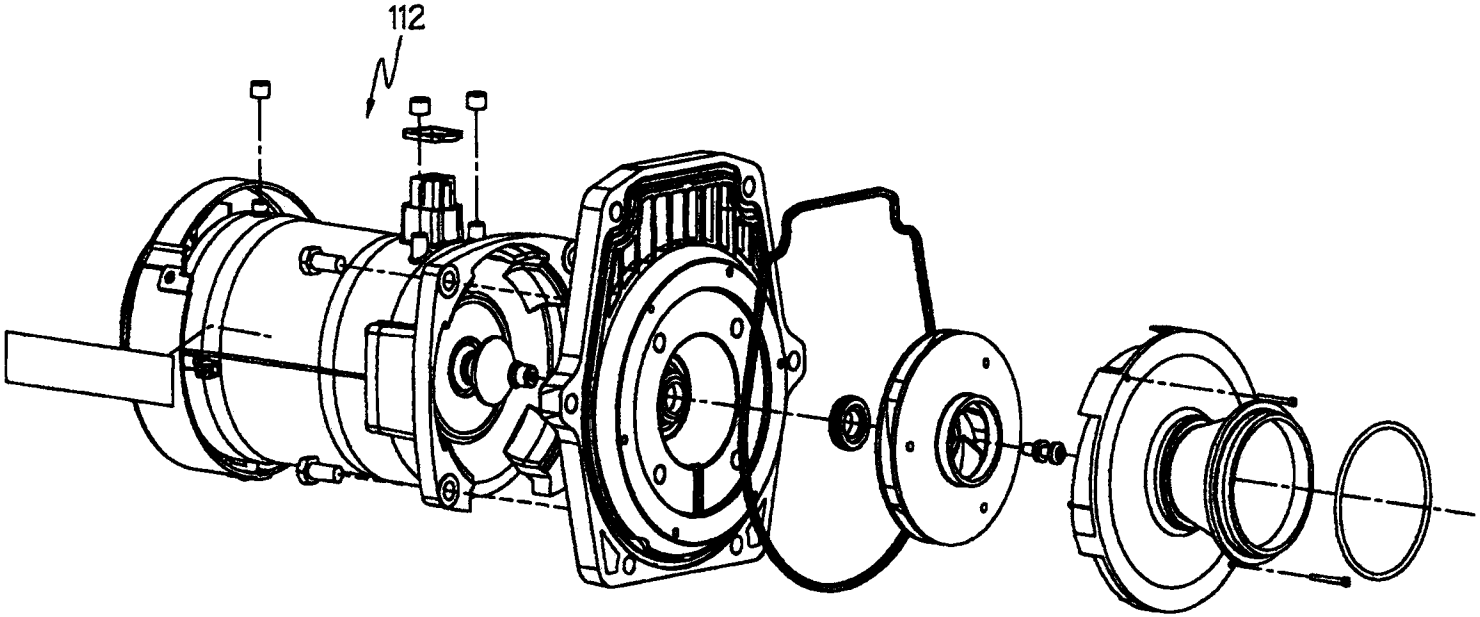
FIG. 7 is a perspective, partially exploded view of a pump of the unit shown in FIG. 6.
Figure 8:
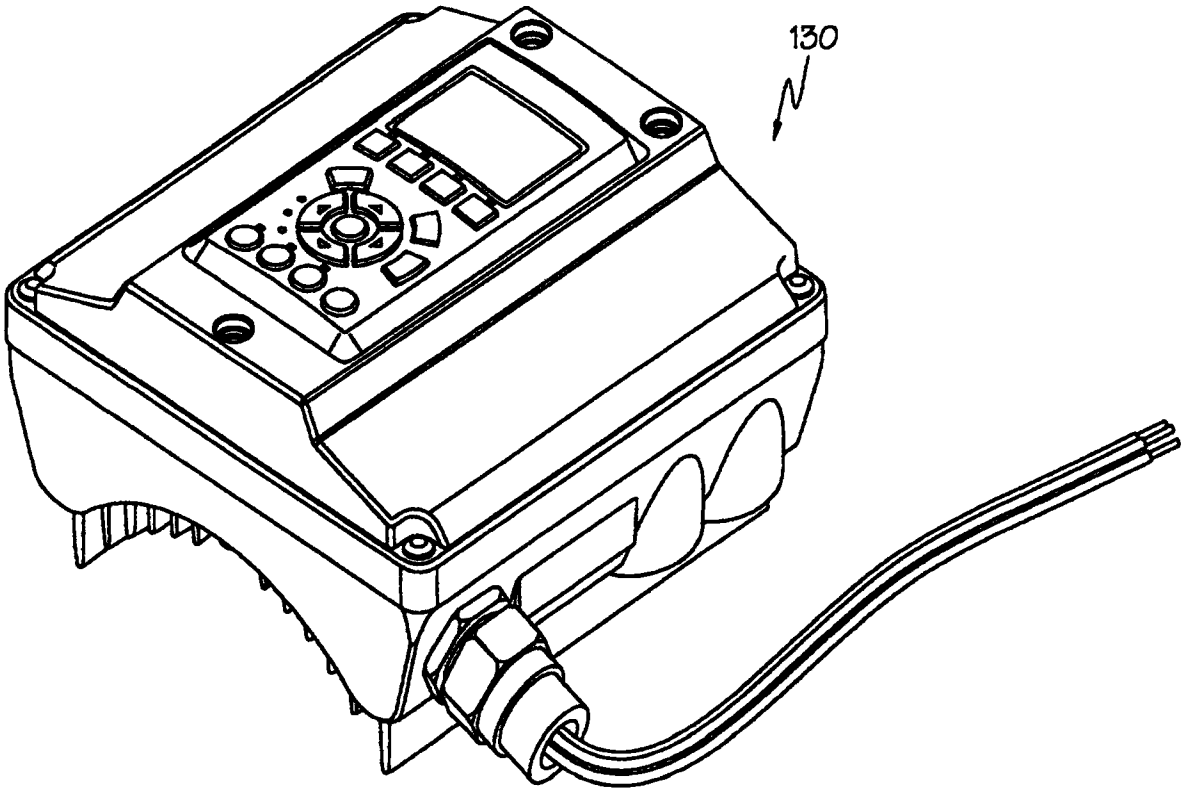
FIG. 8 is a perspective view of a controller unit of the pump unit shown in FIG. 6.

Also, it is to be appreciated that the physical appearance of the components of the system (e.g., 10 or 110) may vary. As some examples of the components, attention is directed to FIGS. 6-8. FIG. 6 is a perspective view of the pump unit 112 and the controller 130 for the system 110 shown in FIG. 2. FIG. 7 is an exploded perspective view of some of the components of the pump unit 112. FIG. 8 is a perspective view of the controller 130.

It should be evident that this disclosure is by way of example and that various changes may be made by adding, modifying or eliminating details without departing from the scope of the teaching contained in this disclosure. As such it is to be appreciated that the person of ordinary skill in the art will perceive changes, modifications, and improvements to the example disclosed herein. Such changes, modifications, and improvements are intended to be within the scope of the present invention.

The invention claimed is:

1. A pumping system for a pool or spa application that pumps water, the pumping system comprising:
- a pump that pumps water through the pool or spa;
- a motor coupled to the pump; and
- a controller in communication with the motor,
  - the controller determining a current flow rate based on an input power to the motor,
  - the controller determining whether the current flow rate is above a priming flow value in order to determine whether the pumping system has become initially primed,
  - the controller indicating a priming alarm if the pumping system has not become initially primed before reaching a maximum priming time allotment;
- wherein the maximum priming time allotment is a fixed time period.

2. The pumping system of claim 1 wherein the controller determines the current flow rate based on the input power to the motor without relying on a flow rate sensor.

3. The pumping system of claim 1 wherein the pump, the motor, and the controller are coupled together in a single pump unit.

4. The pumping system of claim 1 wherein the controller is a variable frequency drive.

5. The pumping system of claim 1 wherein the controller further determines whether the pumping system has lost prime after the pumping system has become initially primed before reaching the maximum priming time allotment, the controller obtaining a hardware input including at least one of input power and motor speed, the controller calculating shaft power based on the hardware input, the controller determining if the pumping system is no longer primed based on the shaft power, the controller indicating a priming dry alarm if the shaft power is at least approaching zero for at least about ten seconds.

6. A pumping system for a pool or spa application that pumps water, the pumping system comprising:
- a pump that pumps water through the pool or spa;
- a motor coupled to the pump; and
- a controller in communication with the motor,
  - the controller determining a current flow rate based on an input power to the motor,
  - the controller determining whether the current flow rate is above a riming flow value in order to determine whether the pumping system has become initially primed,
  - the controller indicating a priming alarm if the pumping system has not become initially primed before reaching a maximum priming time allotment;
- wherein the maximum priming time allotment is a time period between activating the motor and a fixed time period when the pump is primed.

7. A pumping system for a pool or s a application that pumps water, the pumping system comprising:
- a pump that pumps water through the pool or spa;
- a motor coupled to the pump; and
- a controller in communication with the motor,
  - the controller determining a current flow rate based on an input power to the motor,
  - the controller determining whether the current flow rate is above a priming flow value in order to determine whether the pumping system has become initially primed,
  - the controller indicating a priming alarm if the pumping system has not become initially primed before reaching a maximum priming time allotment;
- wherein the controller performs a second operation in which the controller determines a priming status and generates a priming dry alarm subsequent to a first operation in which the controller determines that the pump is initially primed.

8. A pumping system for a pool or spa application that pumps water, the pumping system comprising:
- a pump that pumps water through the pool or spa;
- a motor coupled to the pump; and
- a controller in communication with the motor,
  - the controller determining a current flow rate based on an input power to the motor,
  - the controller adapted to receive a time start indication corresponding to a start time at which a start is activated to begin repetitive operation of a filter mode,
  - a time primed indication corresponding to a primed time at which the current flow rate is determined to be above a priming flow value, and a maximum priming time allotment,
  - the controller indicating a priming alarm if the controller has received the time start indication and has not received the time primed indication prior to the maximum priming time allotment passing after the start time.

9. The pumping system of claim 8 wherein the controller repeatedly compares the current flow rate to the priming flow value after the time start indication and before the passing of the maximum priming time allotment.

10. A method of operating a pumping system for a pool or spa application that pumps water, the pumping system comprising a controller in communication with a motor, the motor coupled to a pump that pumps water through the pool or spa, the method comprising the following sequential steps:
- a) activating a start to begin operation of a filter mode;
- b) determining whether the pumping system is primed and proceeding to step c) if the pumping system is primed and step d) if the pumping system is not primed;
- c) if the pumping system is primed in step b), continuing operation of the filter mode without displaying a priming alarm;

or if the pumping system is not primed in step b), performing the following sequential steps:
- d) performing a flow control process and determining whether the pumping system has become primed;

e) repeating step d) if the pumping system has not become primed as a result of step d); and f) after a maximum priming time allotment has passed from step a), displaying a priming alarm if the pumping system has not become primed as a result of step d), wherein determining whether the pumping system is primed and determining whether the pumping system has become primed each comprise determining a current flow rate based on an input power to the motor and determining whether the current flow rate is above a priming flow value.

11. The method of claim 10, the method comprising the following additional sequential steps:

g) if the pumping system is determined to be primed as a result of steps a) through f), such that the priming alarm has not been displayed, calculating a shaft power based on a hardware input including at least one of input power and motor speed; and h) if the shaft power is at least approaching zero for at least about ten seconds, indicating a priming dry alarm that the pumping system has lost the prime determined in steps a) through f).

* * * * *